US007178470B2

(12) United States Patent
Edinger et al.

(10) Patent No.: US 7,178,470 B2
(45) Date of Patent: Feb. 20, 2007

(54) TABLECLOTH COVERING AND METHOD OF COVERING AND SKIRTING A TABLE

(75) Inventors: Larry Edinger, Westwood, NJ (US); Walter Jones, River Vale, NJ (US); Julian Chan, Chai Wan (HK)

(73) Assignee: SMT Solutions, Inc., Hackensack, NJ (US)

( * ) Notice: Subject to any disclaimer, the term of this patent is extended or adjusted under 35 U.S.C. 154(b) by 0 days.

(21) Appl. No.: 11/074,091

(22) Filed: Mar. 7, 2005

(65) Prior Publication Data

US 2005/0145146 A1 Jul. 7, 2005

Related U.S. Application Data

(63) Continuation-in-part of application No. 10/767,131, filed on Jan. 29, 2004.

(60) Provisional application No. 60/532,121, filed on Dec. 23, 2003.

(51) Int. Cl.
*A47B 13/08* (2006.01)

(52) U.S. Cl. ..... 108/90

(58) Field of Classification Search ..... 108/90; 150/156, 158

See application file for complete search history.

(56) References Cited

U.S. PATENT DOCUMENTS

| | | | | | |
|---|---|---|---|---|---|
| 1,535,895 | A | * | 4/1925 | Blackmore | 108/90 |
| 1,916,435 | A | | 7/1933 | Ott et al. | |
| 1,926,429 | A | * | 9/1933 | Bendelari | 108/90 |
| 2,283,828 | A | * | 5/1942 | Strombach | 108/90 |
| 2,586,153 | A | * | 2/1952 | Irving | 108/90 |
| 2,809,466 | A | * | 10/1957 | Wood | 108/90 |
| 2,954,635 | A | * | 10/1960 | Stotter | 108/90 |
| 3,310,091 | A | * | 3/1967 | Geisen et al. | 108/90 |
| 3,368,601 | A | | 2/1968 | Gantert-Merz | 150/52 |
| 3,557,856 | A | * | 1/1971 | Berman | 108/90 |
| 3,738,405 | A | * | 6/1973 | Ericson | 108/90 |
| 3,959,854 | A | | 6/1976 | Lewis | 24/84 |
| 4,698,117 | A | | 10/1987 | Enison | 156/486 |
| 4,705,084 | A | * | 11/1987 | Rodebaugh et al. | 108/90 |
| 4,708,183 | A | | 11/1987 | Figueroa | 150/52 |
| 4,750,402 | A | * | 6/1988 | Markey | 108/90 |
| 4,883,001 | A | | 11/1989 | Roth | 108/90 |
| 5,069,554 | A | * | 12/1991 | Bonnett | 108/90 |
| 5,084,321 | A | | 1/1992 | Sui | 428/80 |
| 5,240,758 | A | | 8/1993 | Honigberg | 428/100 |
| 5,287,614 | A | | 2/1994 | Ehrlich | 29/450 |
| 5,436,053 | A | | 7/1995 | Herum | 428/128 |
| 5,506,019 | A | | 4/1996 | Abeyta et al. | 428/57 |
| 5,778,802 | A | | 7/1998 | Hairston et al. | 108/90 |
| 5,908,681 | A | | 6/1999 | Foster | 428/99 |
| 6,116,167 | A | | 9/2000 | Rabe | 108/90 |
| 6,334,399 | B1 | | 1/2002 | Kelldorf | 108/90 |

(Continued)

*Primary Examiner*—Jose V. Chen
(74) *Attorney, Agent, or Firm*—St. Onge Steward Johnston & Reens LLC

(57) ABSTRACT

Fitted tablecloth coverings that may be affixed to a table without the use of a tool or affixing devices are manufactured from polymeric film with prefitted corners. Methods of manufacturing a tablecloth from polymeric film with prefitted corners provide a covering that may conveniently and quickly be applied to a table to provide an appealing visual presentation that does not require the use of installation tools and that will not damage the table.

23 Claims, 17 Drawing Sheets

U.S. PATENT DOCUMENTS 6,431,089 B1 * 8/2002 O'Brien ..... 108/90
6,499,411 B2 * 12/2002 Brown ..... 108/90
6,508,183 B2 * 1/2003 Kerrigan ..... 108/90
6,723,668 B2 * 4/2004 Principe ..... 442/316
2002/0043186 A1 4/2002 Kelldorf ..... 108/93
2003/0208836 A1 11/2003 Bankemper ..... 4/245.1
2004/0028853 A1 2/2004 Jackson ..... 428/35.5

* cited by examiner

TABLECLOTH COVERING AND METHOD OF COVERING AND SKIRTING A TABLE

RELATED APPLICATIONS

This patent application is a continuation-in-part of pending U.S. patent application Ser. No. 10/767,131 filed Jan. 29, 2004 which in turn claims priority of U.S. Provisional Patent Application No. 60/532,121, filed Dec. 23, 2003.

FIELD OF THE INVENTION

The invention relates to the field of tablecloth coverings and more particularly, to fitted tablecloth coverings that may be affixed to a table, and a method of covering and skirting a table.

BACKGROUND OF THE INVENTION

Tables used in for instance, trade shows have been utilized for many years. The tables typically have several standard sizes. The visual appeal of the presentation is closely related to the success of the product being advertised.

However, these tables are typically used many times over leading to wear and tear. Therefore, these tables used for trade shows generally require a covering to be placed over the top surface and partially down the side of the table in order to dress up the table and to better present the product being advertised.

Referring to FIGS. 1 and 2, the current industry way of topping trade show tables 10 is utilizing a white vinyl material 12 that comes on, for instance, rolls 14, that is then cut by hand using scissors 16 to fit the approximate size of the table and then is stapled to the side of the table 10 using an industrial staple gun 18. A fabric skirt is then attached to the edge of the table, also by stapling. This approach has many drawbacks.

For instance, because the material 12 comes on a roll 14 and is manually cut to size, it is generally cut much larger than needed and sometimes under cut, therefore creating wasted material.

Another problem is that current installation of the vinyl to the tabletop is to staple the material 12 directly to the sides of the table 10. The staples 20 damage the wood upon insertion and when the vinyl 12 is removed after the show; it is torn off leaving the staples 20 in the table. This greatly reduces the life span of the table as well as many wasted man hours removing the staples 20 by hand using a staple removal tool 22 (see FIG. 3).

Still another problem is that as the staples 20 accumulate on the side of the table 10, it becomes increasing difficult to install the vinyl top and skirting. Also, as the tables 10 are removed as well as brought to the events they are placed on table dollies (not shown). During this procedure it is very common for equipment handlers to become injured from protruding staples. In addition, during such events, exhibitors themselves and attendees can become injured as well as clothing and trade show materials can become damaged from protruding un-removed staples.

Finally, the current installation procedure is time consuming with the vinyl material 12 coming on a roll 14 making it cumbersome to handle. For example, the roll 14 is heavy typically weighing from 25 to 100 pounds, and thus, is hard to carry and manage in order to cut in sizes and thereafter to apply on the tables.

SUMMARY OF THE INVENTION

What is desired then is an apparatus and method that will address the aforementioned problems.

Accordingly, it is an object of the present invention to provide a tablecloth that may conveniently and quickly be affixed to a table and to provide an appealing visual presentation.

This and other objects of the invention are achieved by providing a tablecloth that is pre-sized according to standard table dimensions.

Some of the benefits to use of the present invention include for instance, there is no wasted material because the tablecloth is pre-cut to the correct size.

In addition, the installation and removal of the tablecloth take very little time and pre-made tablecloths allow for a more exact piece count when, for instance, shipping to a show site.

According to one aspect of the present invention, a table cover for covering a tabletop, comprises: a top cover for covering a top surface of a tabletop, the top cover having a generally polygonal contour with a plurality of sides at its outer periphery thereof; and, a plurality of side drops, each extending outwards from the respective one of the sides of the top cover, each of two adjacent ones of the side drops defining an adjoining corner with a first drop fold area and a second drop fold area configured to fold for binding the respective adjoining corner of the side drops with an adjacent side drop of the plurality of side drops. The first and second drop fold areas are preferably symmetrical to each other, configured to fold and bind by binding agents, sewing, application of heat, or other known binding methods. The table cover is useful, in particular, as a trade show tablecloth. The table cover is preferably formed of a resilient material such as vinyl, and the top cover can be made to a dimension a little shorter than that of the tabletop and is applicable to cover the tabletop by stretching it.

According to another aspect of the present invention, a table cover for covering a tabletop, comprises: a top cover for covering a top surface of a tabletop, the top cover formed of a resilient material and sized a little smaller than the top surface of the tabletop, the top cover including a plurality of sides at its outer periphery thereof; and, a plurality of side drops formed of a resilient material, each of the side drops extending outwards from the respective one of the sides of the top cover, each of two adjacent ones of the side drops defining an adjoining corner, each of the adjoining corners being folded and bound respectively to an adjacent side drop of the plurality of side drops.

According to another aspect of the present invention, a covered table comprises a tabletop covered with a resilient table cover, the table cover having a top cover and a plurality of side drop portions extending from the top cover, each of two adjacent side drop portions defining an adjoining corner area there-between, the adjoining corner areas each being folded and bound to at least one of two adjacent side drop portions of the table cover, thereby forming a plurality of fitted corners of the table cover. The covered table preferably includes a skirt attached around the sides of the tabletop on top of the fitted sides of the table cover. The skirt can be formed of a fabric material and attached to the tabletop by applying a plurality of staples, tacks, or pins.

According to another aspect of the present invention, a method of making a table cover for covering a tabletop, comprises: providing a table cover formed of a resilient material and having a top cover and a plurality of side drop portions, the top cover being sized a little smaller than the top surface of the tabletop, the side drop portions including a plurality of adjoining corner areas between two adjacent side drop portions, each of the corner area including a first drop fold area and a second drop fold area; folding each of the adjoining corner areas about the first and second drop fold areas; and, binding each of the folded adjoining corner areas with adjacent side drop portions of the table cover so as to make the side drop portions drawn in a generally vertical direction when the table cover is placed over the tabletop.

According to still another aspect of the present invention, a method of placing a table cover over a tabletop, comprising: providing a table cover formed of a resilient material and having a top cover and a plurality of side drop portions, the top cover being sized a little smaller than the top surface of the tabletop, the side drop portions including an adjoining corner area between two adjacent side drop portions, each of the corner area including a first drop fold area and a second drop fold area, the adjoining corner area being folded and bound to at least one of the two adjacent side drop portions of the table cover, thereby forming a plurality of fitted corners of the table cover; locking at least two of the fitted corners of the table cover onto corresponding corners of the tabletop; pulling and stretching the table cover across over opposite corners of the tabletop; and, locking the rest of the fitted corners of the table cover onto corresponding corners of the tabletop.

According to a further aspect of the present invention, a method of applying table coverings onto a table, the table having a tabletop, the method comprises: providing a table cover formed of a resilient material and having a top cover and a plurality of side drop portions, the top cover being sized a little smaller than the top surface of the tabletop, the side drop portions including an adjoining corner area between two adjacent side drop portions, each of the corner area including a first drop fold area and a second drop fold area, the adjoining corner area being folded and bound to at least one of the two adjacent side drop portions of the table cover, thereby forming a plurality of fitted corners of the table cover; locking at least two of the fitted corners of the table cover onto corresponding corners of the tabletop; pulling and stretching the table cover across over opposite corners of the tabletop; locking the rest of the fitted corners of the table cover onto corresponding corners of the tabletop; providing a skirt formed of a fabric material and dimensioned to cover side areas of the table; and, attaching the skirt around the tabletop on top of the fitted sides of the table cover.

The invention and its particular features and advantages will become more apparent form the following detailed description considered with reference to the accompanying drawings.

DETAILED DESCRIPTION OF THE DRAWINGS

Figure 5:
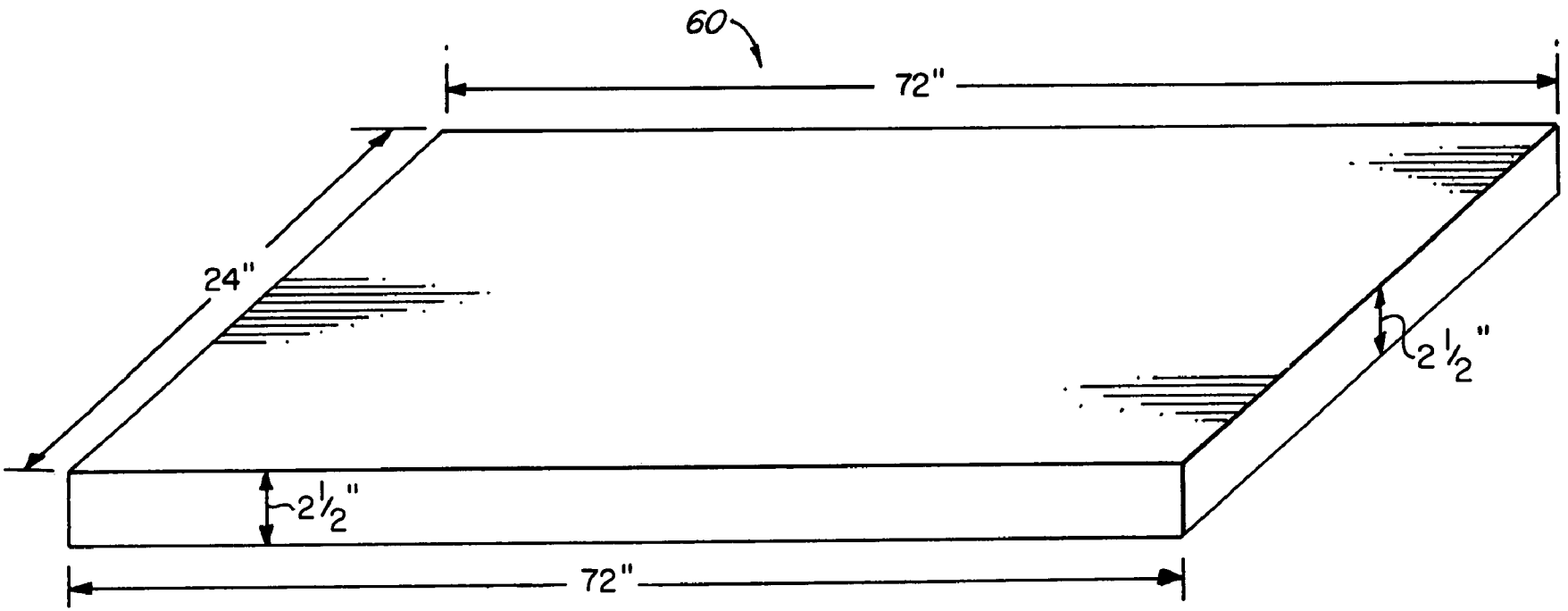
FIG. 5 is a perspective view of a typical table top showing dimensions of surfaces to be covered by the tablecloth.
Figure 6:
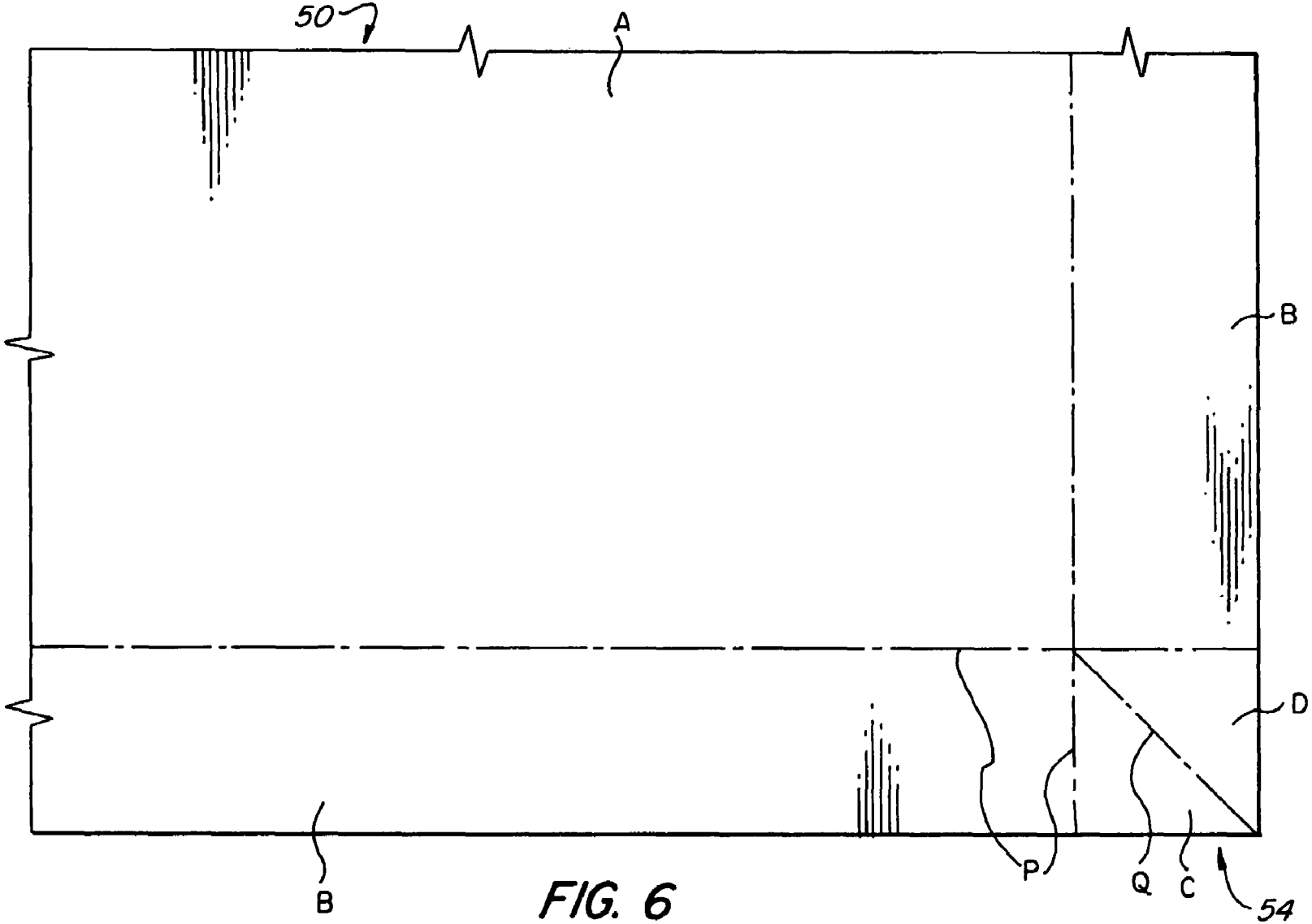
FIG. 6 is a partial top view of the tablecloth according to one preferred embodiment of the present invention.

In one preferred embodiment of the present invention, a custom fitted, slip over tablecloth is provided that installs onto, for example, trade show tables with a non-intrusive application. With reference to FIG. 6, a tablecloth 50 includes a top cover "A" for covering the top surface of a tabletop 60 (FIGS. 4–5), and a plurality of (e.g., four) side drop portions "B" extending outwards from the top cover "A". The tablecloth material is precut to size to accommodate the existing size tables that are offered, or any other size tables for applying thereon. In a trade show, for example, the site may accommodate many tables of different dimensions. For applying the tablecloths of the invention to these tables, the exact number of the tablecloths 50 can be cut to the corresponding sizes and shipped to the show site. As such, many tablecloths 50 can be cut in advance to cover the existing tables of one or many different dimensions.

Existing standard size tables are typically 24" wide, for instance, with the dimension of 24"×48" (4 foot table), 24"×72" (6 foot table) and 24"×96" (8 foot table) and having a 2½" drop (i.e., thickness) on all sides, respectively. Other table sizes are also available including, but without limiting thereto, 18" wide tables and 30" wide tables with several different lengths. FIG. 5 illustrates a typical dimension of standard six foot table, for example. If such standard size tables are accommodated in a trade shows as is very common, the number of the tablecloths for each standard size can be counted before the show, and appropriate purchase orders for the tablecloths can be made in advance. Thus, covering of the trade show tables can be done quickly and conveniently utilizing the pre-cut and fitted tablecloths of the invention (which will be described herein below in details).

The present invention, however, is not intended to be limited to any particular sizes and configurations of such tabletops. For example, the tablecloth of the invention is also applicable to any custom made tables with a wide variety of different sizes or to tables for home or office use. It is also applicable to a tabletop having a rectangular, hexagonal, other polygonal configuration, or round or elliptical configuration.

Tablecloths 50 are preferably formed of a thin resilient material such as a thin vinyl. For example, a thin and flexible PVC (polyvinyl chloride) film of flame retardant property with a thickness of preferably about 0.3 mm to about 0.8 mm, more preferably about 0.4 mm to about 0.6 mm, can be used for the material. Various other polymers or synthetic resins, or resilient fabric materials may also be used. However, tablecloth 50 can be formed of a substantially non-resilient material. Tablecloth 50 may be transparent, white, colored, or include suitable decorations or pictures thereon.

The top cover "A" of the tablecloth 50 is sized a little shorter than the actual dimension of the tabletop 60 so the resilient material may be stretched to fit tightly onto the tabletop 60. The side drops "B" of the tablecloth 50 is preferably a little wider than the drop size of the table 60 to sufficiently cover there over. For example, in order to apply onto the conventional size tabletops with two and a half inch drops (see FIG. 5), thin vinyl material is cut into a rectangular shaped table cover 50 with the central top-cover portion "A" dimensioned about 1% to about 5% shorter than the size of the tabletop and the side drops 52 dimensioned to be about three inch wide. Typical dimensions of the top-cover portion "A" are as follows (when using flexible PVC film or other synthetic resins of similar flexibility with a thickness of about 0.4 mm to about 0.6 mm):

| Tabletop Size | Top Cover "A" Width | Top Cover "A" Length |
|---|---|---|
| 18" × 48" | About 17.5" | About 46" to about 47.5" |
| 18" × 72" | About 17.5" | About 69" to about 71" |
| 18" × 96" | About 17.5" | About 92" to about 95" |
| 24" × 48" | About 23.5" | About 46 to about 47.5" |
| 24" × 72" | About 23.5" | About 69" to about 71" |
| 24" × 96" | About 23.5" | About 92" to about 95" |
| 30" × 48" | About 29" | About 46" to about 47.5" |
| 30" × 72" | About 29" | About 69" to about 71" |
| 30" × 96" | About 29" | About 92" to about 95" |

According to one preferred embodiment of the present invention as described herein below, four corners of the tablecloth 50 are now suitably folded and then bound with respective adjacent side drops 52 of the tablecloth 50 in order to provide a custom "fitted" cover applicable over the tabletop 60.

Figure 7:
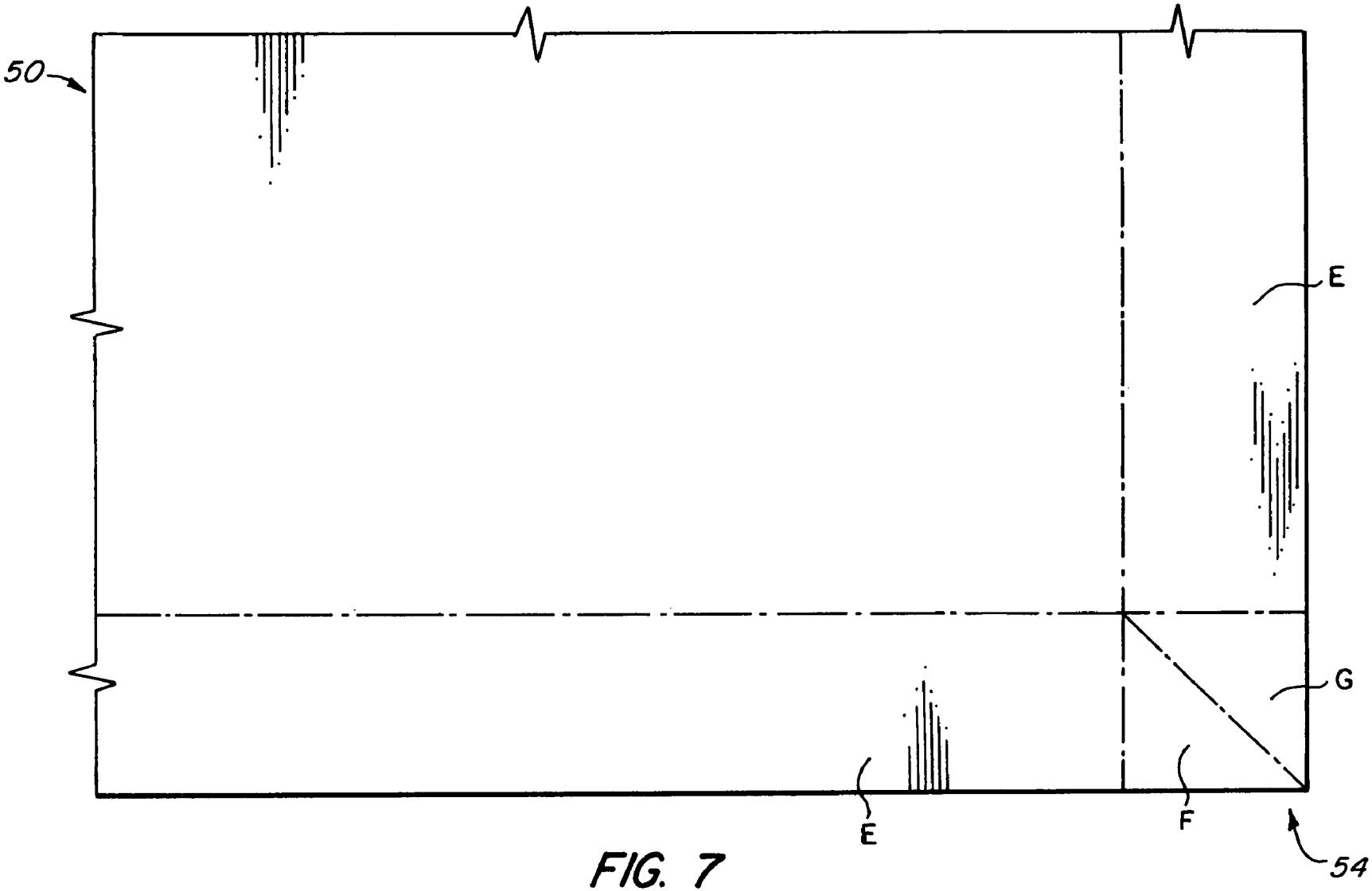
FIG. 7 is a partial bottom view of one preferred embodiment of the present invention according to FIG. 6.
Figure 8:
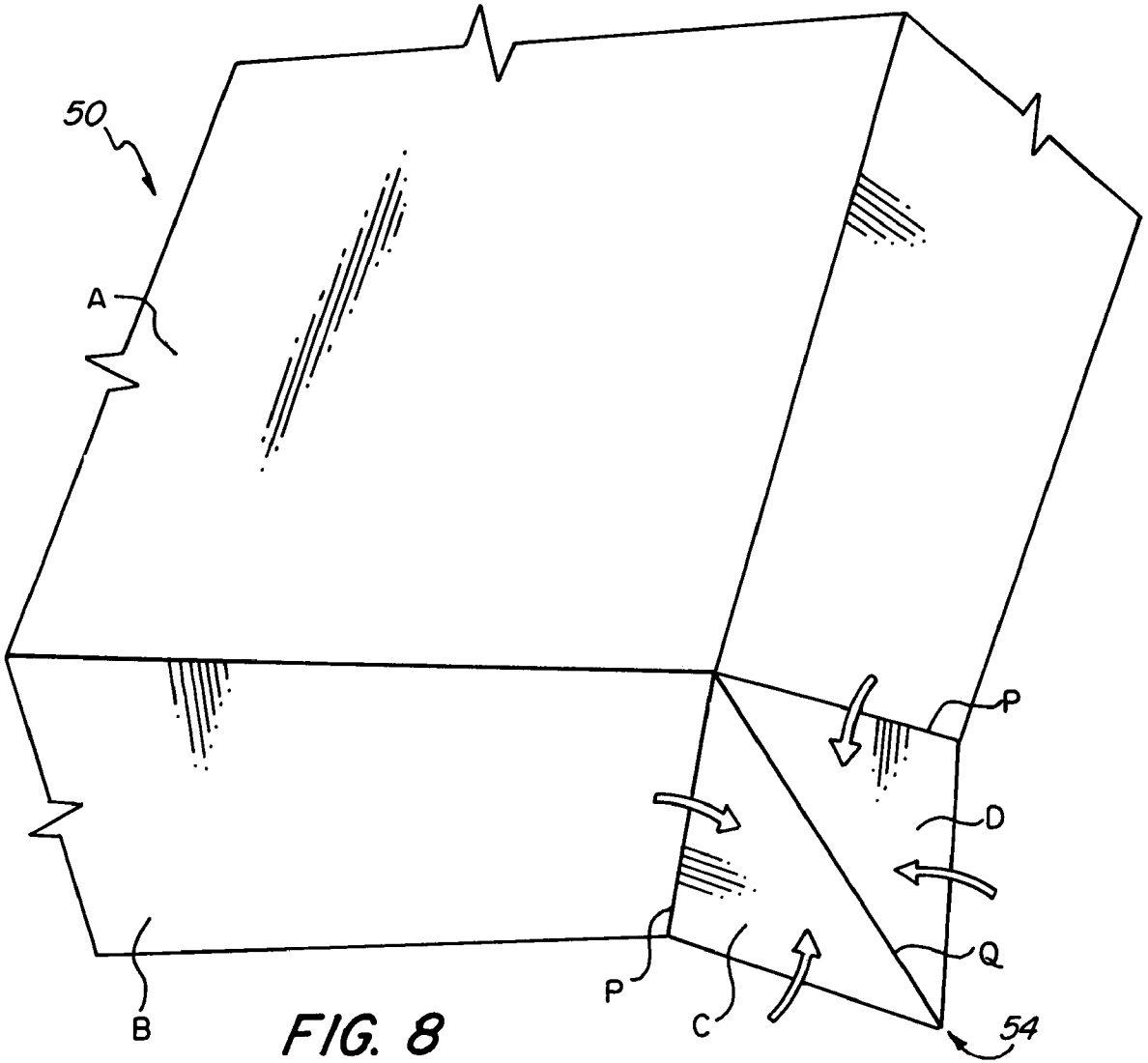
FIG. 8 is a partial top view of the tablecloth according to FIG. 6 showing a folding of a corner.
Figure 9:
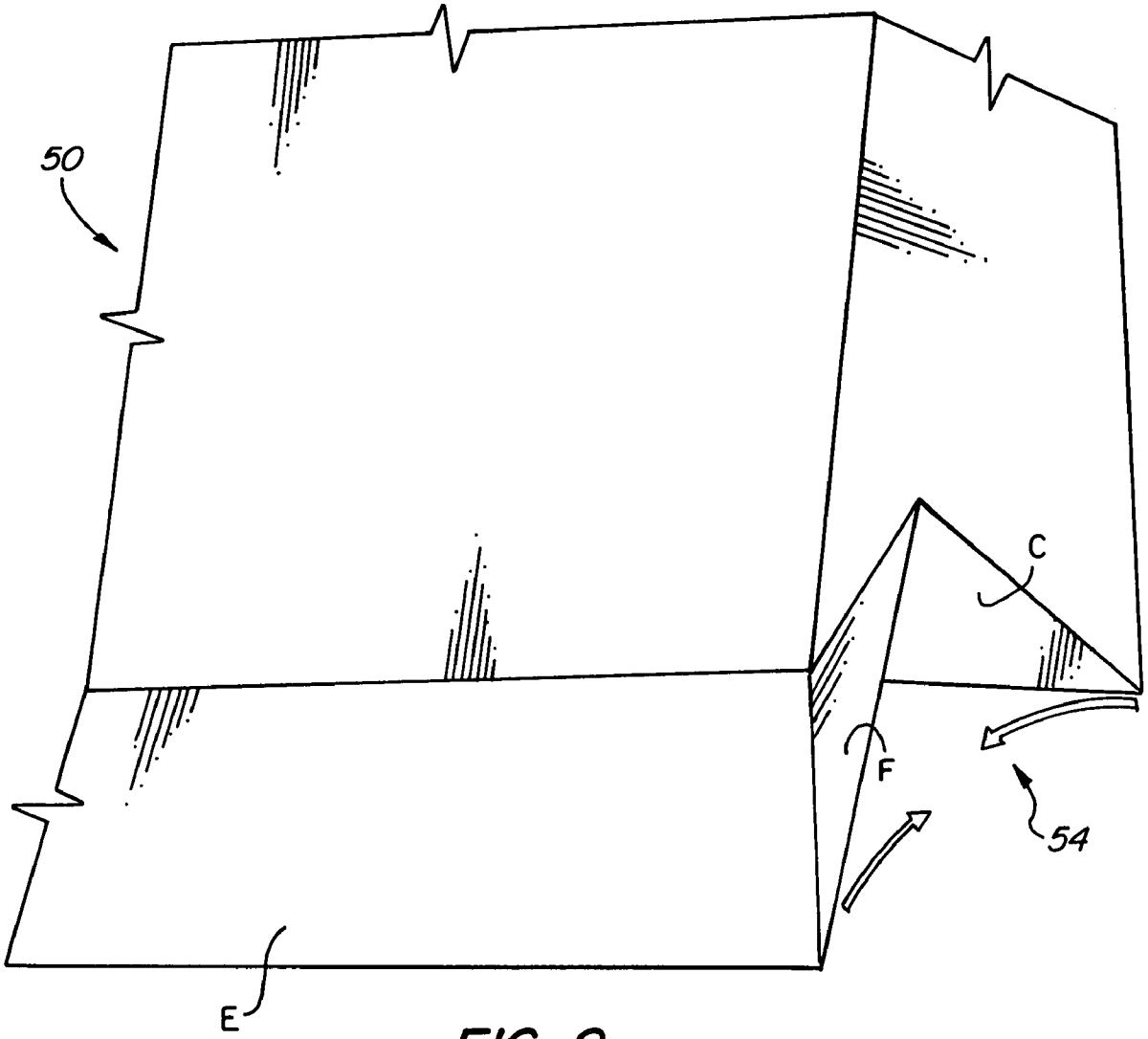
FIG. 9 is a partial bottom view of the tablecloth according to FIG. 8.
Figure 10:
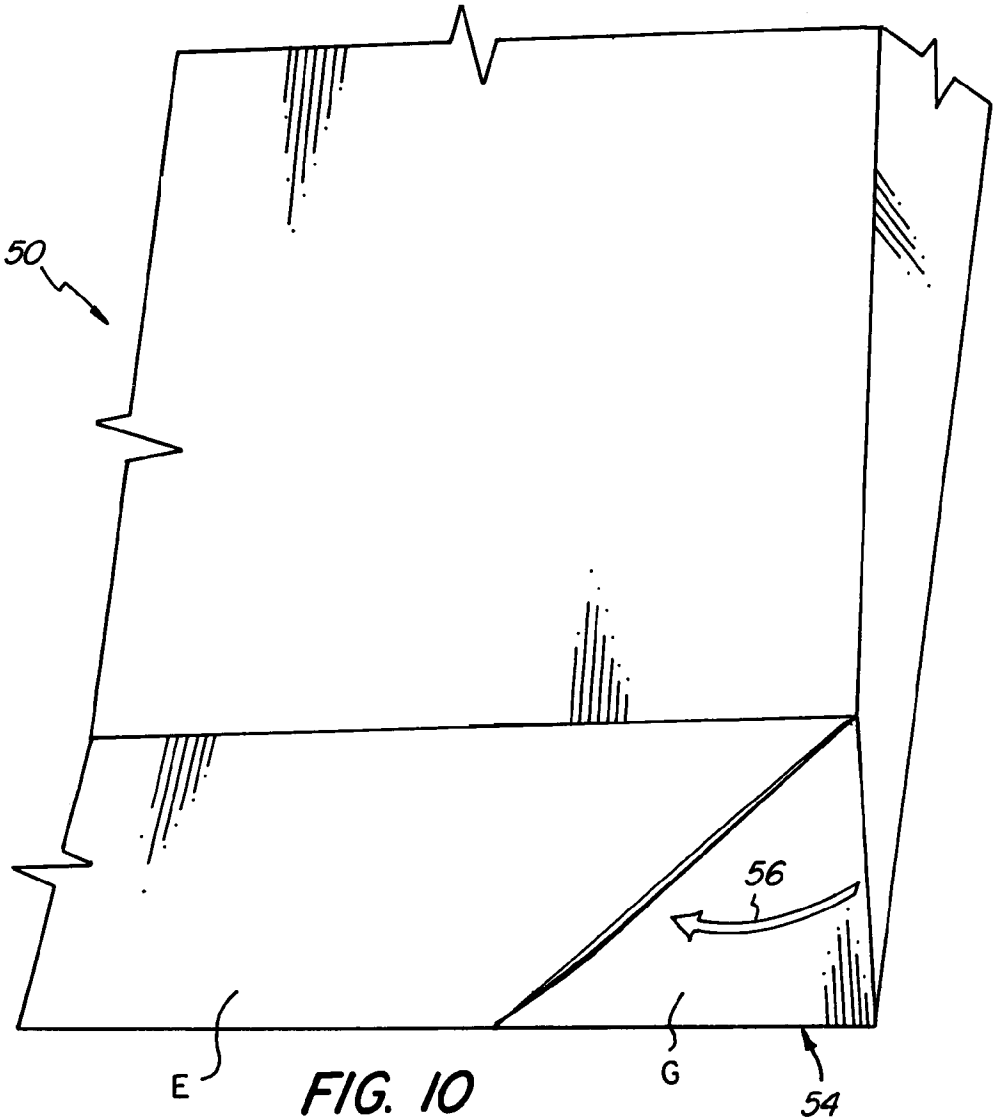
FIG. 10 is a partial bottom view of the tablecloth according to FIG. 9 illustrating a further fold of the corner for binding onto an inside drop of the tablecloth.

With reference to FIG. 6 which shows the tablecloth from outside of the tablecloth, the side drops "B" of the tablecloth 50 are first folded backwards along lines "P". Then, each corner area 54 defined by the folding is now inversely folded along line "Q" as shown in FIG. 8. This forms a first drop fold area "C" and a second drop fold area "D" at the corner area 54, each in a triangular shape facing one another. Then, the first and second drop fold areas C and D are bound to each other by a conventional binding method. Typically, binding agents are applied on the areas C and D for the connection thereof. However, other binding methods can also be applied, for example, such as vinyl welding, riveting, sewing, gluing, elastic or hot knifed or sonic welding, heat formed connection, and Velcro-type connection, etc. After binding of the areas C and D, binding agents are similarly applied to an opposite side of the corner area 54, i.e., on the left inside drop fold area F (shown FIGS. 7 and 8). Then, the combined corner 54 is folded toward a direction 56, and the drop fold area F is bound to the inside drop E as shown in FIG. 10. Alternately, the corner 54 can be folded in an opposite direction (i.e., inversely to the direction 56) and bound onto the other side of drop E, with binding agents previously applied there-about.

The above-described folding and binding is repeated on all four sides. To facilitate the folding of the corners, boundary identification lines "P" and "Q" can be printed in advance on the tablecloth 50, preferably with ink or in pressed or embedded lines. Finished exterior corners illustrate only the areas A and B as finished corners when seen from the outside. This finished process creates a monolithic table covering for fitting over a tabletop.

The following are letter keys for use in reference with FIGS. 6–10:

For 3" Drop fold—

A: Top cover=24"×48"/72"/96" (when applied on tabletop)
B: Outside drop
C: Outside drop fold (left)
D: Outside drop fold (right)
E: Inside drop
F: Inside drop fold (left)
G: Inside drop fold (right)

Where, C is combined or fused to D; and F is combined or fused to E.

Figure 12:
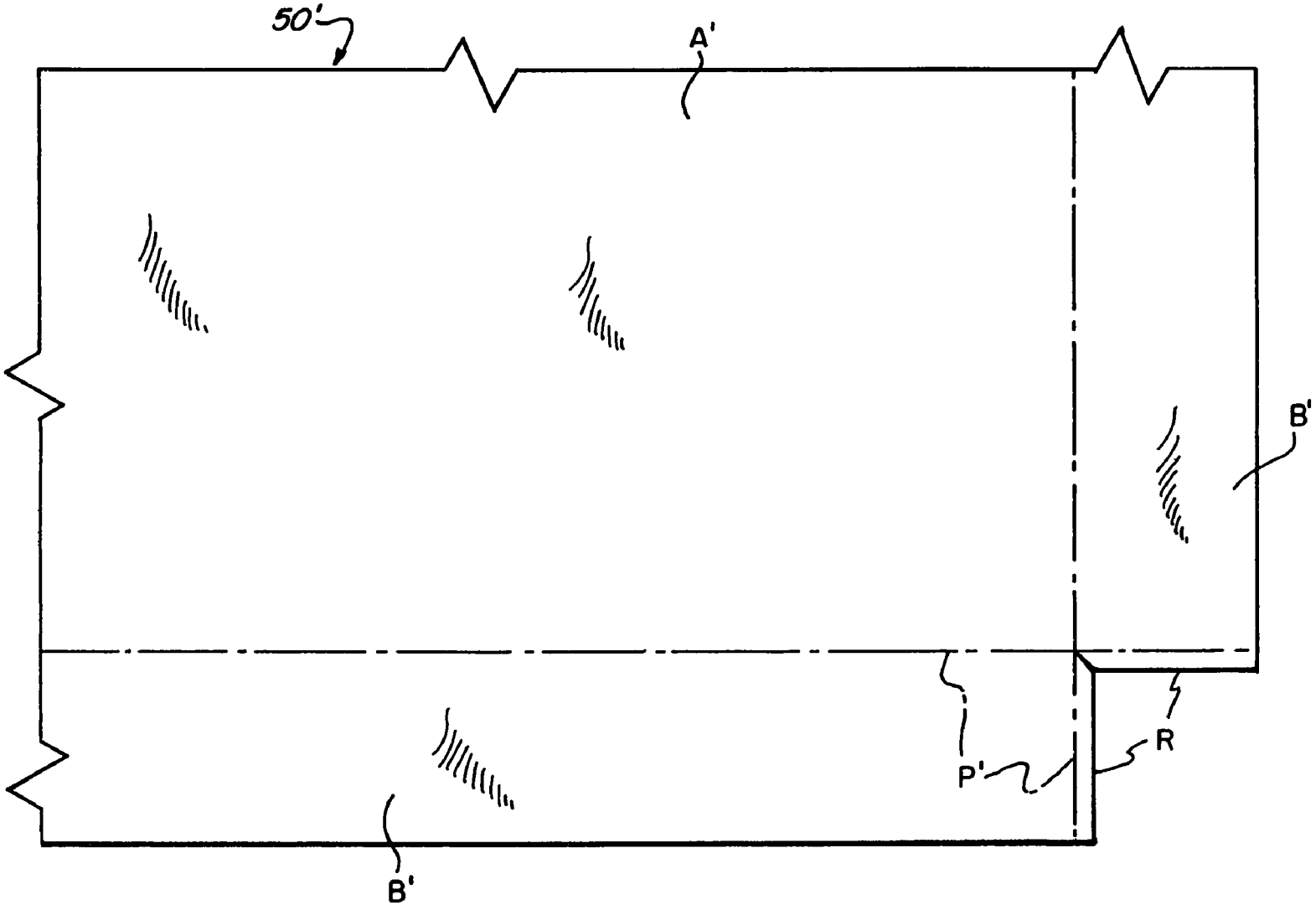
FIG. 12 is a partial bottom view of the tablecloth according to another preferred embodiment of the present invention.
Figure 13:
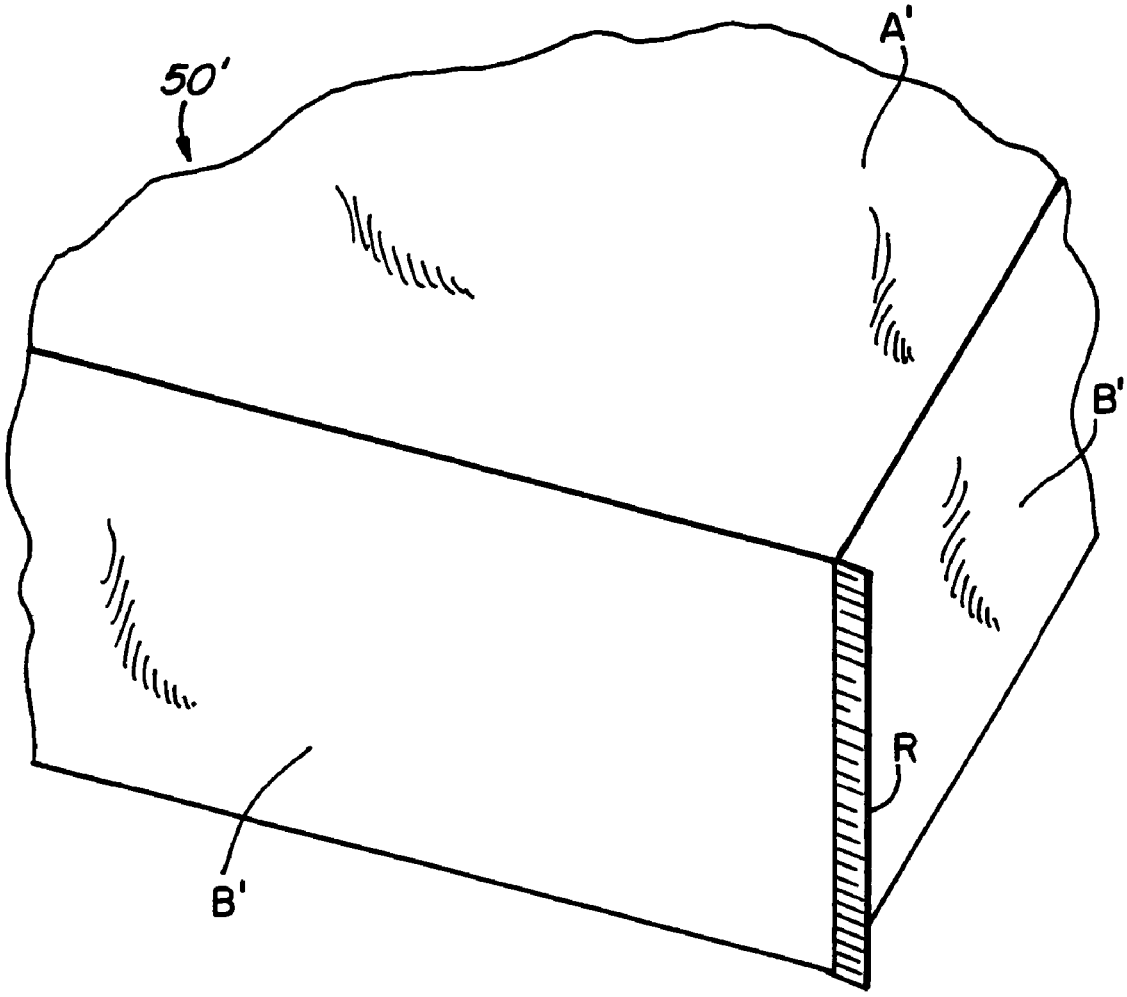
FIG. 13 is a partial bottom view of the tablecloth according to FIG. 9 illustrating a bound state of one corner of the tablecloth.

With reference to FIGS. 12–13, another preferred embodiment of the tablecloth or table cover is described herein. Tablecloth 50' is basically the same or similar to the tablecloth 50 above described except that specified herein below. Thus, detail descriptions of such similar features are not repeated herein for simplicity purposes.

Tablecloth 50' includes top cover A' and plural (e.g., four) side drops B' extending outwardly from the top cover A'. The top cover A' and side drops B' are similarly configured as that of top cover A and side drops B of the tablecloth 50 as in FIGS. 6–10. However, in this embodiment, corner area 54 are precut, and side drops B' each have narrow strip area R extending laterally from the side end of each side drop B'. These strip areas R are for folding along the fold lines P', and each of the neighboring strips R are bound according to known connection methods applicable to polymer materials of the tablecloth 50', such as PVC film. For example, after facing the neighboring strips R in close contact with each other, the strips R are fused and combined together by applying heat energy such as radio frequency energy onto the strips. FIG. 13 shows the binding state at each corner of the tablecloth 50'.

Figure 1:
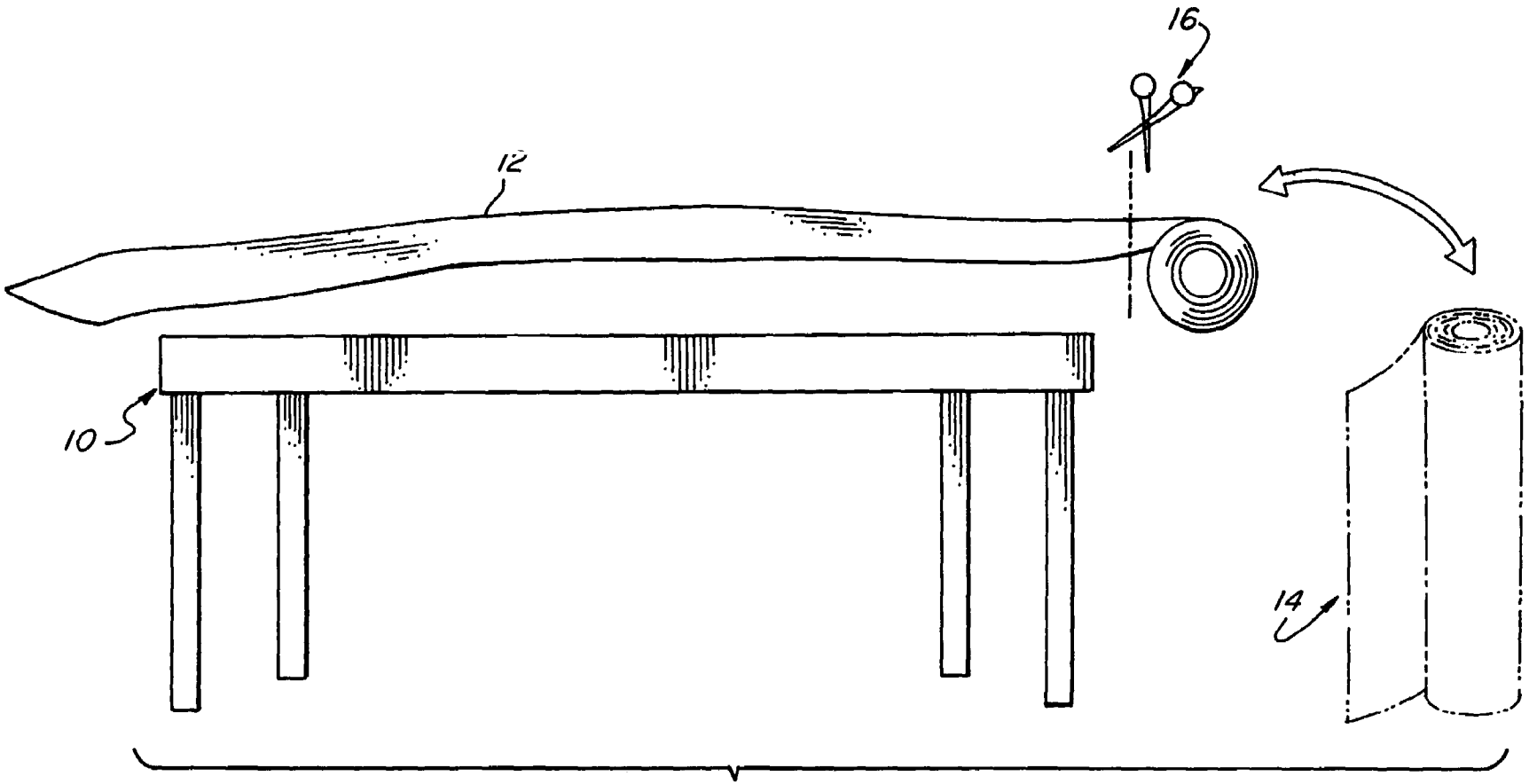
FIG. 1 (PRIOR ART)
FIG. 1 illustrates installation of a tablecloth covering according to a method known in the prior art.
Figure 2:
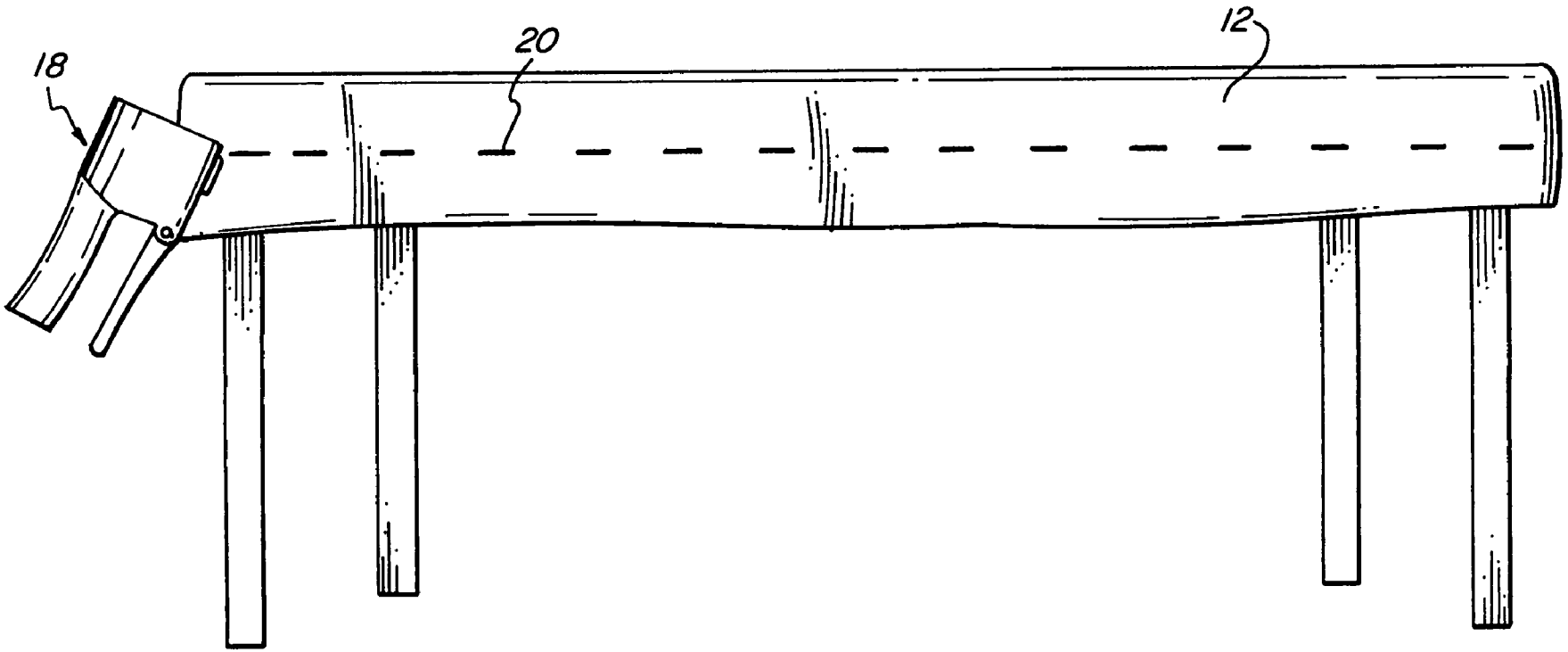
FIG. 2 (PRIOR ART)
FIG. 2 illustrates installation of the tablecloth covering of FIG. 1, showing the tablecloth being stapled to the side of the table.
Figure 3:
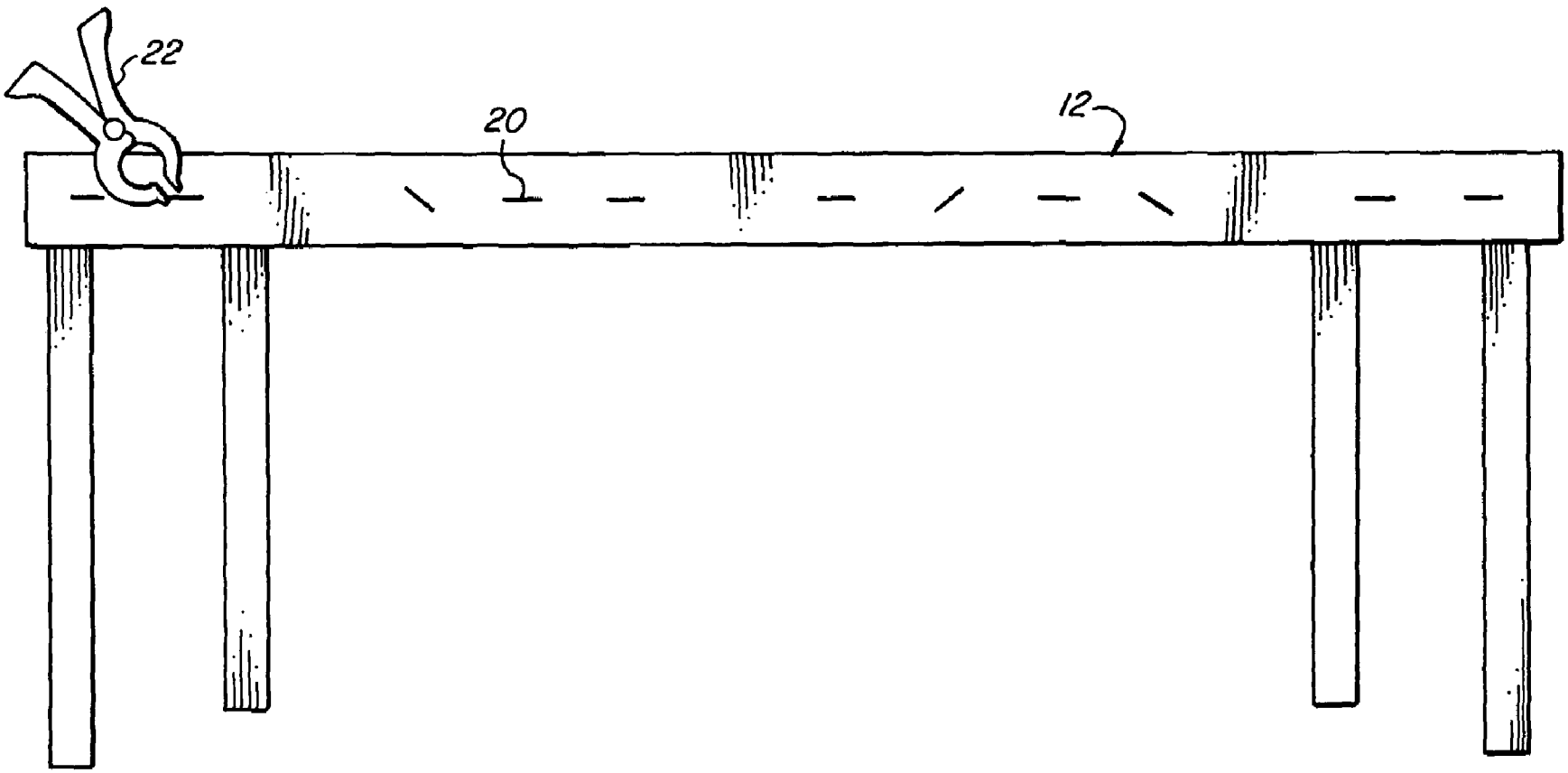
FIG. 3 (PRIOR ART)
FIG. 3 illustrates removal of the staples according to the prior art.
Figure 4A:
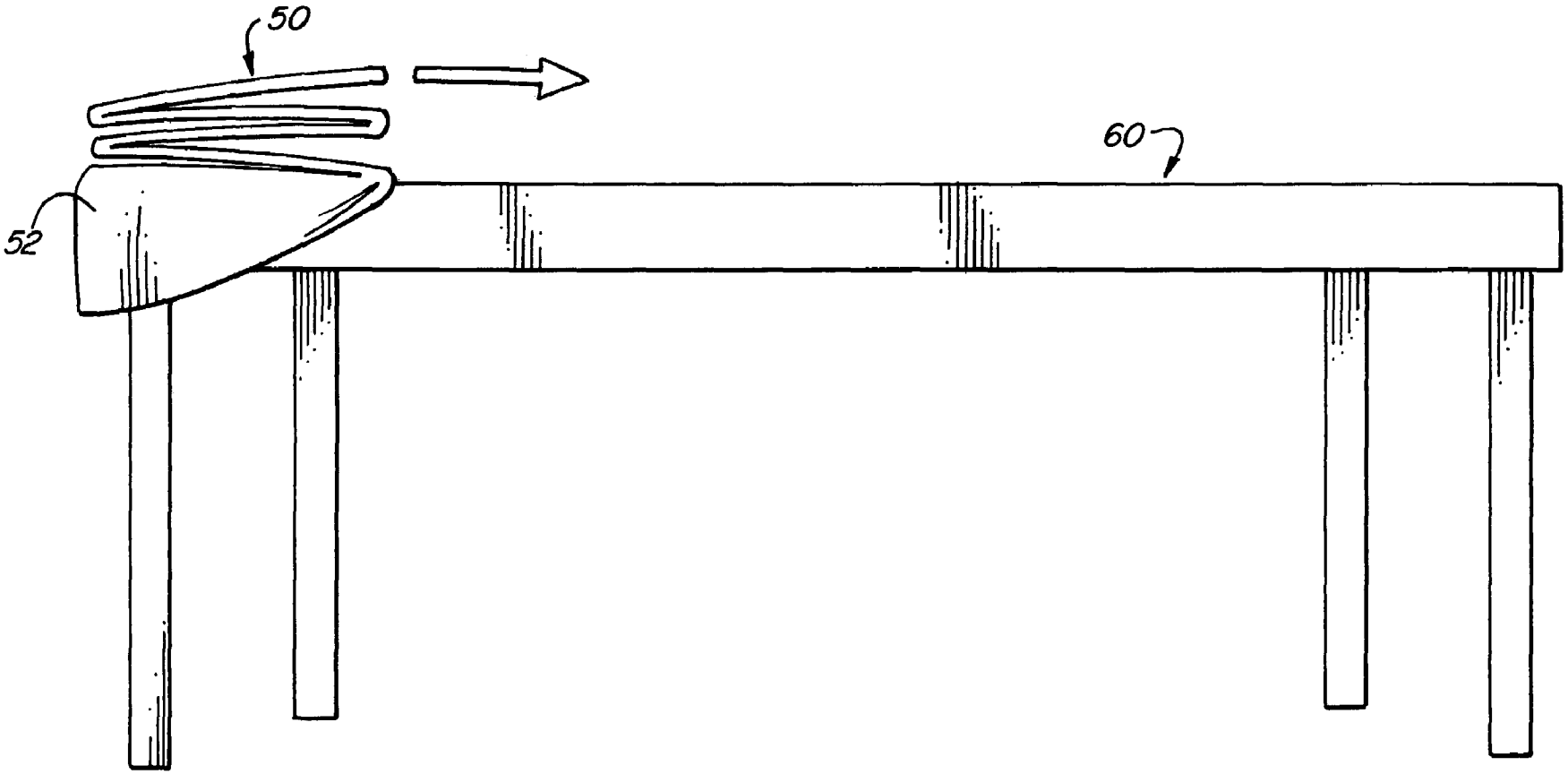
FIG. 4A is an illustration of one preferred embodiment of the present invention showing the tablecloth being initially applied to one end of the table.
Figure 4B:
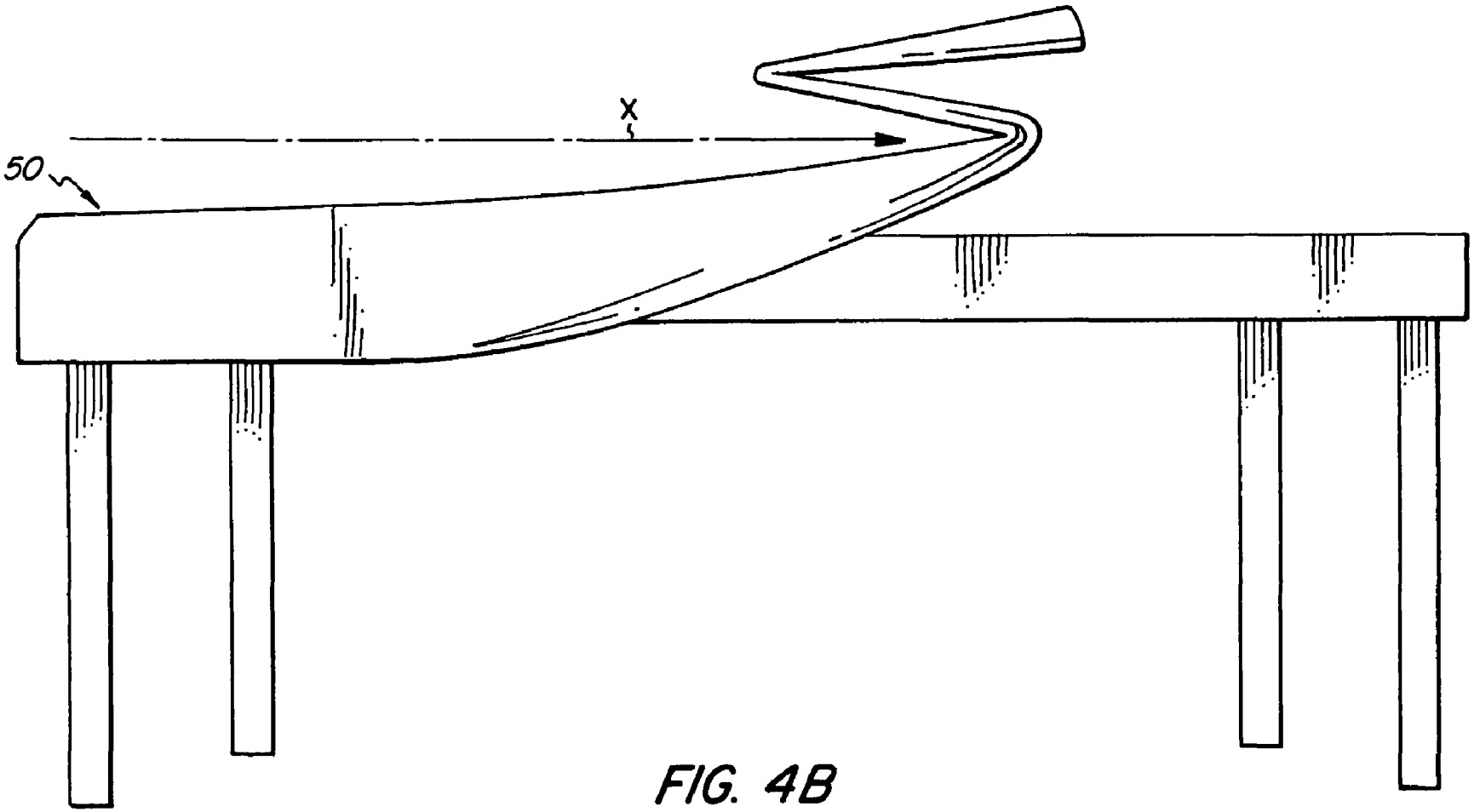
FIG. 4B is an illustration of one preferred embodiment of the present invention according to FIG. 4A, showing the tablecloth being drawn across to the table.
Figure 4C:
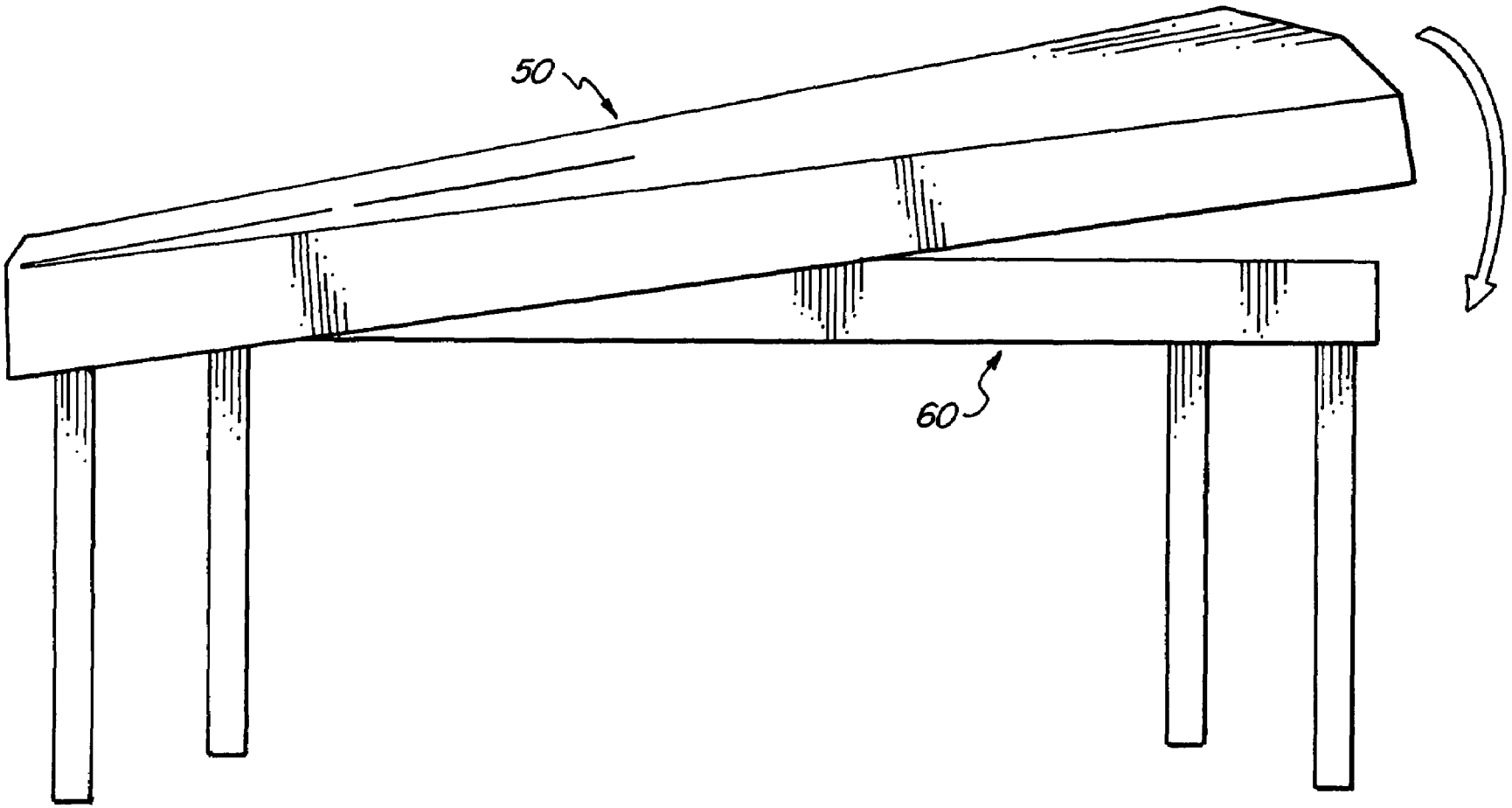
FIG. 4C is an illustration of one preferred embodiment of the present invention according to FIG. 4A, showing the tablecloth being applied over an opposite end of the table.
Figure 4D:
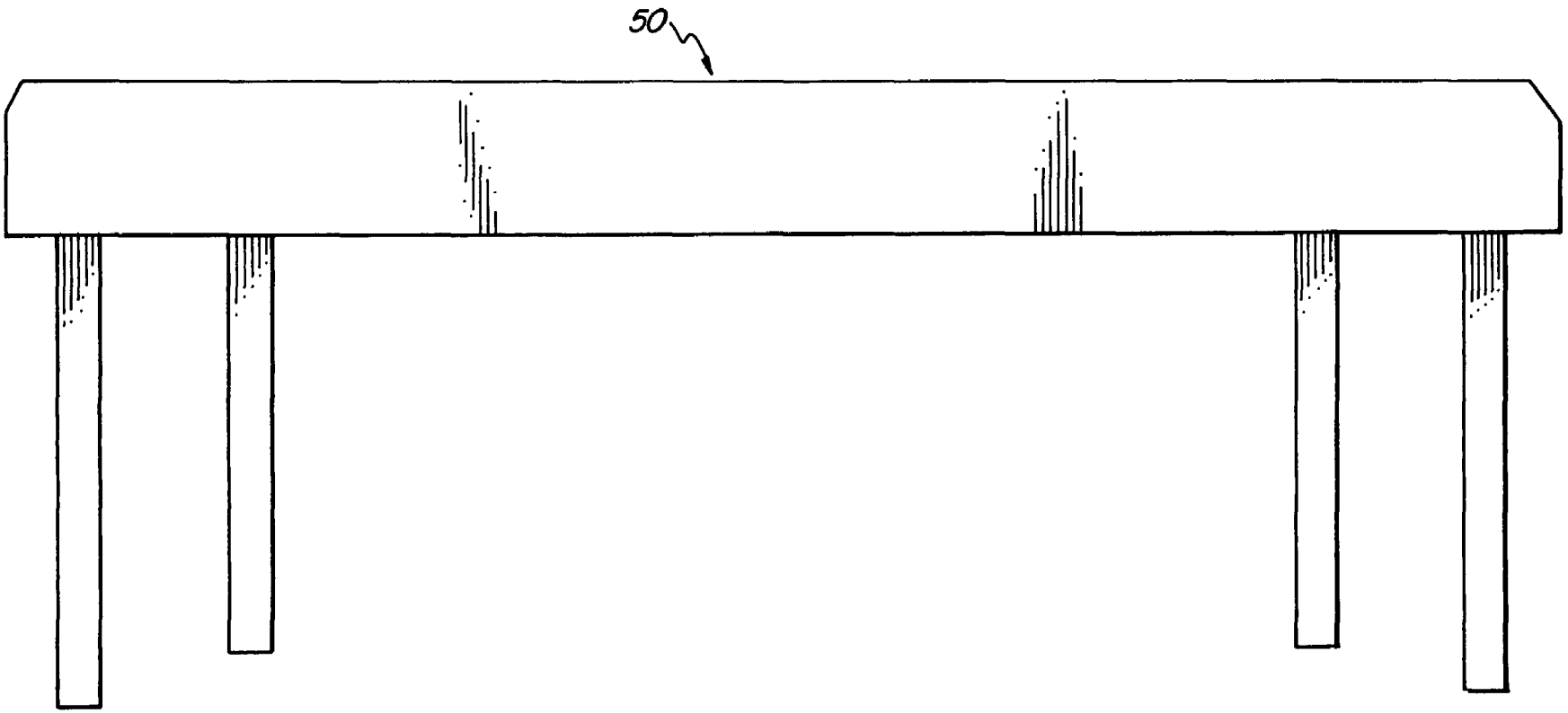
FIG. 4D is an illustration of one preferred embodiment of the present invention according to FIG. 4A, showing the tablecloth applied to the table.

In accordance with one preferred embodiment of the invention, application of the tablecloth or table cover 50 is described herein, with reference to FIGS. 4A–4C. Two formed corners 52 of the tablecloth 50 (or 50') are first locked onto two corresponding corners on one lateral side of the tabletop 60, as shown in FIG. 4A. Then, the tablecloth 50 is drawn across the corners on the opposite sides of the table, as indicated by arrow "X" in FIG. 4B. Now, the resilient material 50 is pulled and stretched a little, and the rest two formed corners of the tablecloth 50 are locked onto two corresponding corners of the table as shown in FIG. 4C, thus allowing for a custom "fitted" top. Here, in order to prevent development of wrinkles on the fitted tablecloth 50, the resilient tablecloth 50 can be adequately pulled and smoothed by the hands or with the aid of a ruler or a straight bar. The tablecloth 50 covers the top of the table as well as the lip around the four sides as shown in FIG. 4D.

Figure 14:
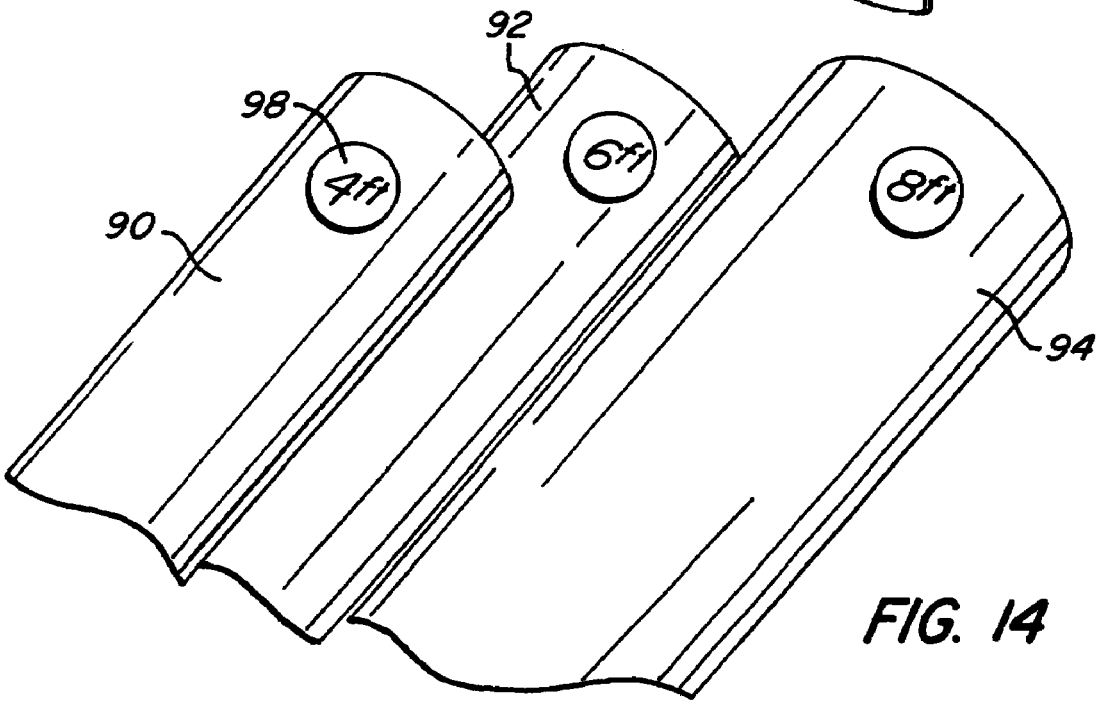
FIG. 14 is a partial perspective view illustrating the tablecloths of the invention provided in rolls of several different sizes.

With reference to FIG. 14, each of the table covers 50 (and 50') is provide, for example, to trade show sites preferably in a separately rolled form for easiness of its supply and handling. For that, an elongate tube of about ¼ inch diameter can be used as a rolling tool in order to roll each tablecloth 50 in orderly form without wrinkling, which is removed from the tablecloth roll after the rolling. Plural tablecloth rolls, such as rolls 90 for 4 foot long tables, rolls 92 for 6 foot long tables, and rolls 94 for 8 foot long tables, can be boxed in a suitable container or carton box for shipping to desired locations such as trade show sites. In order to facilitate quick identification of their sizes (particularly, when the sites have a lot of tables of different size), it is preferable that each roll contains a size identification at a suitable location of the roll, such as stickers 98 indicating the size of the table on which the tablecloth is intended to be applied.

Such tables with their tabletops 60 covered by the resilient tablecloth 50 can be used, for example, as trade show tables. However, in accordance with another preferred embodiment of the invention as described herein below, the tables can be preferably covered by additional skirts around the side areas of the table.

Figure 11:
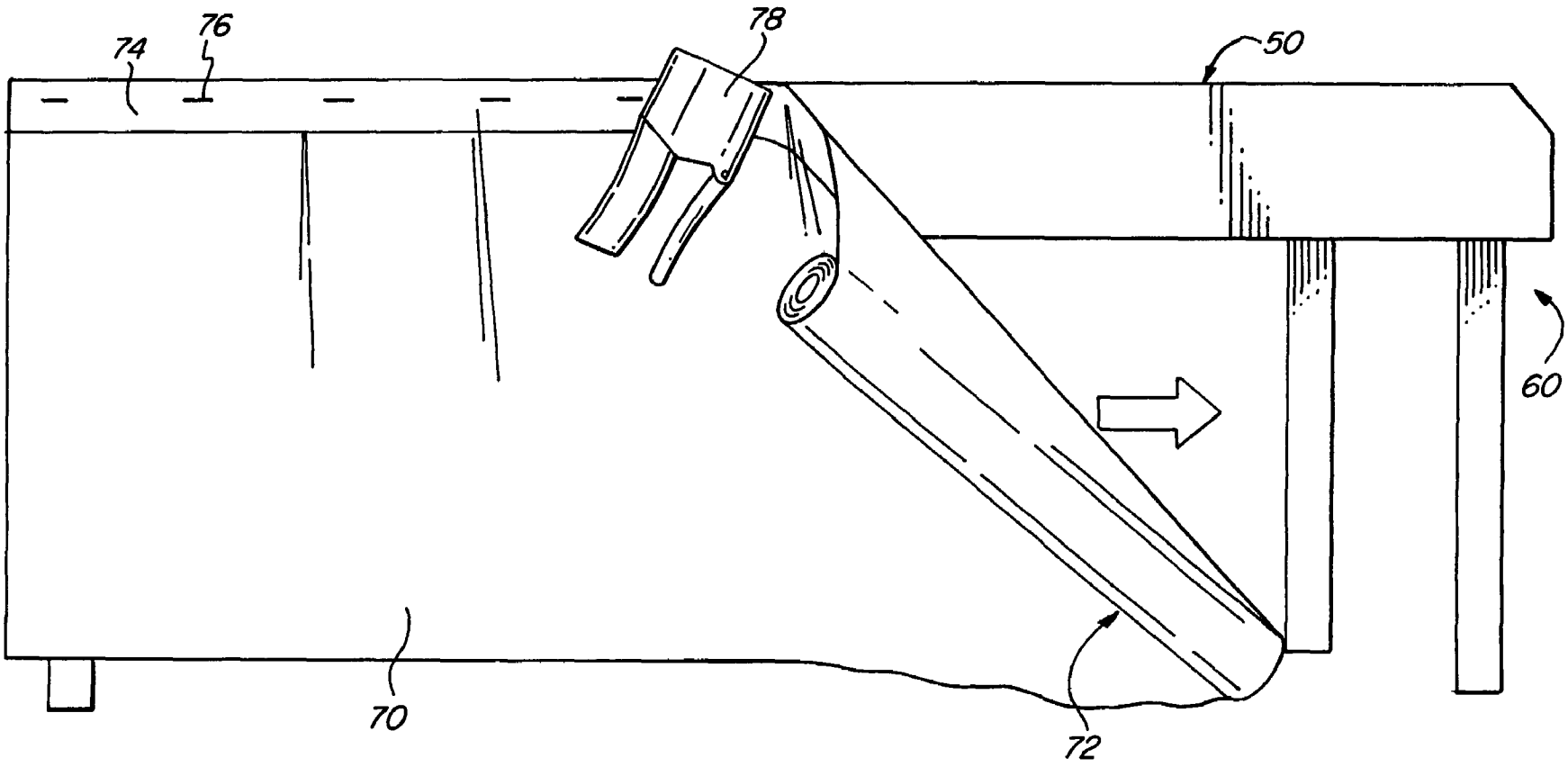
FIG. 11 is a perspective view of one preferred embodiment of the present invention, illustrating application of a skirt along the sides of the tabletop on top of the covered tablecloth.

With reference now to FIG. 11, application of side skirts onto the covered table is described herein in accordance with one embodiment of the invention. Skirt 70 is preferably formed of fabric or a similar material which is generally tougher than the resilient tablecloth material. The skirt 70 has a width for suitably covering the sides of the table, and can be provided in a roll 72 for use after cut to a desired size to surround at least the front side, and more preferably at least the front and two lateral sides of the table. However, the skirt 70 may be provided in a predetermined standard length. For example, the skirt 70 can have a precut length of about 13 feet. When using this 13 foot long skirt, a standard eight-foot table (2 feet×8 feet) can be covered by the front (8 feet) and two lateral sides (2+2, i.e., 4 feet), and a little of the rear side, that is, about 0.5 foot on each lateral side of the rear side. Likewise, a standard six-foot table (2 feet×6 feet) can be covered by the front (6 feet) and two lateral sides (4 feet) and about 1.5 feet on each lateral side of the rear side, and a standard four-four table (2 feet×4 feet) can be covered by the entire sides of the table that is 12 foot long (i.e., 4+4+2+2). Supply of table skirts of a fixed size (e.g., 13 feet) may have some advantages since the skirts of a uniform length can be used to cover any kind of standard size tables often used in ordinary trade shows, realizing saving of substantial labor time and cost for preparing and installing such table skirts onto a large numbers of tables as in a big trade show. It is particularly noted that covering of at least three sides (i.e., front and two lateral sides) has also a practical usage for trade show tables since the covered sides can be exposed towards the customers and the uncovered side (if any) can be used by the host of the trade tables, or vice versa if it is more desirable.

The skirt 70 may include a reinforced band 74 around the top, area of the skirt. The band 74 is similarly formed of a fabric-like material and can provide a tougher foundation for applying staples or tacks, as will be described herein below.

A free end of the rolled skirt 70 is first affixed onto a side of the tabletop 60 with staples 76 applied along the side of the tabletop 60 by using a suitable staple applicator 78. Instead of applying staples 76, other known fasteners such as pins, tacks, or the like can be applied either by hands or using an applicator known in the art. The remaining portion of the skirt 70 is now adequately placed onto the sides of the tabletop 60 and affixed there-around in a similar way. During installation of the skirt 70, the tablecloth may be further pulled tight to remove wrinkles. Also, it is advantageous to apply the fasteners (such as staples, tacks, or pins) onto the reinforced band 74 because it can more securely hold the staples or the like. Accordingly, covered tables of appealing appearance can be provided for using, for example, in a trade show.

One preferred method for disassembly of the coverings (i.e., the skirt 70 and the tablecloth 50) is now described. First, one end side of the fabric skirt 70, which is affixed onto the tabletop 60 by staples 76, is pulled for disassembly. Since the skirt is formed of a fabric material and preferably reinforced with the band 74, this pulling action causes the corresponding portions of the fabric skirt 70 and the staples 76 to be detached from the tabletop 60 without damaging the skirt 70 and the tablecloth 50. The remaining portion of the skirt 70 is then pulled to complete the disassembly of the skirt and the staples (or tacks).

Now, the tablecloth 50 is peeled off from the tabletop 60 in a reverse order to that of the application of the tablecloth as described above, and this completes the disassembly process. The tablecloth 50 removed from the tabletop 60 is typically discarded. However, since the removed tablecloth 50 my not be damaged, it can be reused for a later trade show.

Figure 15:
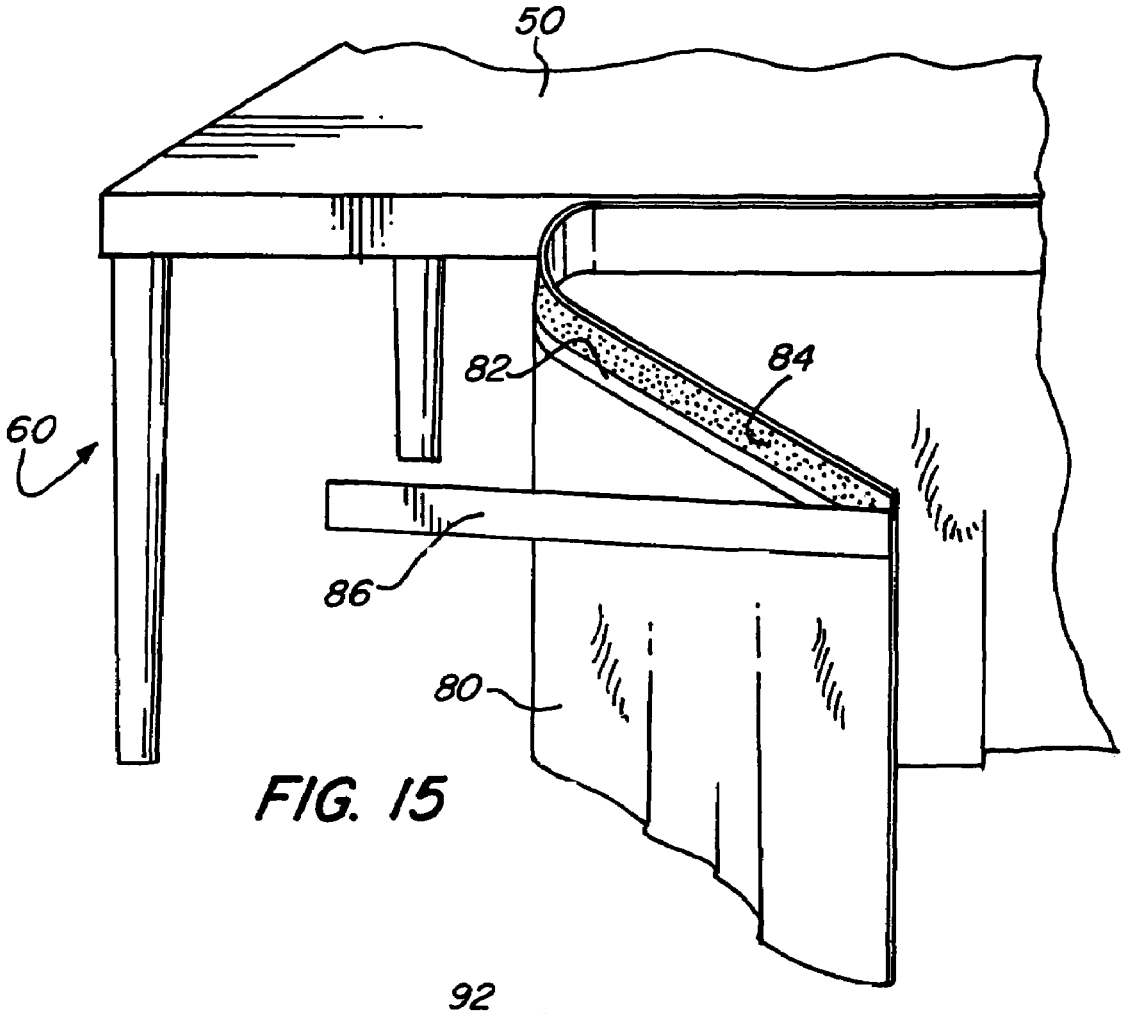
FIG. 15 is a partial perspective view illustrating a skirt according to another preferred embodiment of the invention and application of the skirt along the sides of the tabletop on top of the covered tablecloth.

With reference now to FIG. 15, alternate embodiment of the skirts of the invention and application of the skirts onto the covered table is described herein. Similar to the skirt 70 described above in connection with FIG. 11, skirt 80 of this embodiment is preferably formed of fabric to provide soft and amicable feelings to the site. Various colors and decorations can also be provided on the skirts or tablecloths of the invention. Skirt 80 can be made of other suitable materials known in the art such as polymer materials or the like. The skirt 80 includes a polymer or vinyl band 82 which is attached to the skirt along its upper inside area preferably by sewing or by other suitable means. The band 82 forms a base structure for applying adhesive 84 thereon in order to attach the skirt 80 on the side of the tabletop, preferably on top of the tablecloth 50 previously covered thereon.

According to one preferred embodiment of the invention, the adhesive 84 is in the form of a double sided adhesive tape which is covered by a protective strip 86 attached thereon. The protective layer 86 may be formed of waxed paper, vinyl material, or the like. When fixing the skirt 80 onto the tables, the protective layer 85 is peeled off from the polymer band 82 and the adhesive 84 of the skirt 80 is suitably pressed onto the side of the tabletops.

As described above in connection with to the description of the skirts 70, the skirts 80 can also be provided in a uniform size, for example, 13 foot long for covering at least the front and two lateral sides of the standard size tables of trade shows. Alternatively, the skirts can be provided in a roll of extended length for use after cut to a desired length for each use.

Utilizing the skirt 80 of this embodiment, the skirts can be more easily attached to the covered tables without damaging the tables by applying staples or tacks or other fasteners as used by the conventional methods discussed above. Disassembly of the skirts 80 can also be performed simply by peeling off the skirts, and no staples or fasteners are to be remained at the tables because such fasteners are not needed at all when fixing the skirts 80 to the tables. Disassembled skirts and tablecloths can be simply discarded after the particular trade show. This may save excessive storage and handling costs for the used table coverings.

As discussed above, the present invention provides new and convenient tablecloths and skirts, along with new methods of applying such tablecloths and skirts of the invention. The invention can simplify the cumbersome and labor consuming process of applying table covers on the tables, particularly for display tables of a trade show. In particular, when a trade show site has a great number of tables of standard sizes, the invention can save a substantial amount of labor and installation costs for applying the coverings before the show. The tables covered with the coverings of the invention may provide an appealing outlook for successful presentation in the trade shows. The tables covered by the inventive coverings will not be damaged by staples or other fasteners. Safety and other values are also enhanced substantially.

Although the invention has been described with reference to several embodiments with certain constructions, structures, ingredients and formulations and the like, these are not intended to exhaust all possible arrangements or features, and indeed many other modifications and variations will be ascertainable to those of skill in the art. For example, the tablecloth of the invention may have a hexagonal (or other polygonal) shape, as described above, for accommodating with a similarly shaped tabletop. Then, its drop fold areas may have a different shape other than that described above to adequately fold and bind to an adjacent side drop.

What is claimed is:

1. A table cover for covering a generally rectangular table of pre-determined size comprising:

a top surface made of a polymeric film having a generally rectangular configuration with a length and a width and four edges;

four sides formed of the polymeric film, each extending outwardly from a respective one of the edges of the top surface and bent down at an angle of about 90° from the top surface such that the four sides together define a length and a width that is substantially the same as the length and the width of the top surface, and each of the four sides having a free edge opposite to a respective edge of the top surface and two end edges orthogonal to the top surface;

wherein the adjacent end edges of each of two respective sides abut one another and are permanently joined together to define four corners to hold the table cover on the table; and wherein the free edges of each of the four sides together define a length and a width that are substantially the same as the length and the width of the top surface.

2. The table cover of claim 1, wherein the polymeric material is flame retardant PVC film.

3. The table cover of claim 1, wherein the adjacent end edges are sealed by application of heat.

4. The table cover of claim 1, wherein the adjacent end edges are sealed by application of binding agents.

5. The table cover of claim 1, wherein the adjacent end edges are sealed by sewing.

6. The table cover of claim 1, wherein the table cover is for covering a trade show table of a standard length and width.

7. The table cover of claim 6, wherein the length and the width of the table cover are generally the same as the standard length and width of the trade show table.

8. The table cover of claim 7, wherein the table cover further comprises a size identification disposed on a location of the table cover visible to a user for selection prior to placement on the table.

9. The table cover of claim 8, wherein the size identification is a marking noting the length of the table cover.

10. The table cover of claim 9, wherein the length marking is selected from the group consisting of a sticker applied to the polymeric film, a stamp on the polymeric film, and a heat weld in the polymeric film.

11. A method of forming a table cover for covering a table of generally pre-determined size and having a top surface and a plurality of sides, said method comprising the steps of:

providing a polymeric film in a generally rectangular shape having a length and width and four corners;

removing generally rectangular portions of the polymeric film at each of the four corners of the polymeric film so as to define a generally rectangular central portion having a length and a width and four generally rectangular side portions, each side portion having an edge contiguous with the central portion, each side portion having two opposite ends created by the removal of polymeric material, and each side portion terminating at a free edge opposite to the edge that is contiguous with the central portion;

bending each of the four side portions to be generally orthogonal to the central portion such that each one of the two opposite ends of each side portion abut another one of the two opposite ends of another adjacent side portion and such that the free edges of the side portions define a length and a width that are substantially the same as the length and the width of the central portion; and permanently joining the abutting ends of the side portions to form four fitted corners of the table cover that hold the table cover on the table once the table cover is placed thereon.

12. The method of claim 11, wherein the rectangular portions that are removed are generally square.

13. The method of claim 11, wherein the polymeric film is a flame retardant PVC film.

14. The method of claim 11, wherein the sealing step is achieved by application of heat.

15. The method of claim 11, wherein sealing step is achieved by binding agents.

16. The method of claim 11, wherein the sealing step is achieved by sewing.

17. The table cover of claim 11, wherein the sealing step is achieved by radio frequency welding.

18. The method of claim 11, wherein the table cover is for covering a trade show table of standard length and width.

19. The method of claim 18, wherein the length and the width of the table cover are generally the same as the standard length and width of the trade show table.

20. The method of claim 11, further comprising the step of marking the table cover with a size identification so it is visible to the user for selection prior to placement on the table.

21. The method of claim 20, wherein marking the table cover with the size identification comprises heat welding a mark noting the length of the table cover into the polymeric film.

22. The method of claim 20, wherein marking the table cover with the size identification comprises applying a sticker noting the length of the table cover to the polymeric film.

23. The method of claim 20, wherein marking the length with the size identification comprises stamping a mark noting the length of the table cover on the polymeric film.

* * * * *

US007178470C1

(12) EX PARTE REEXAMINATION CERTIFICATE (6530th)

United States Patent
Edinger et al.

(10) Number: US 7,178,470 C1
(45) Certificate Issued: Nov. 18, 2008

(54) TABLECLOTH COVERING AND METHOD OF COVERING AND SKIRTING A TABLE

(75) Inventors: Larry Edinger, Westwood, NJ (US); Walter Jones, River Vale, NJ (US); Julian Chan, Chai Wan (HK)

(73) Assignee: SMT Solutions, Inc., Hackensack, NJ (US)

Reexamination Request:
No. 90/008,659, May 18, 2007

Reexamination Certificate for:

| | |
|---|---|
| Patent No.: | **7,178,470** |
| Issued: | **Feb. 20, 2007** |
| Appl. No.: | **11/074,091** |
| Filed: | **Mar. 7, 2005** |

Related U.S. Application Data

(63) Continuation-in-part of application No. 10/767,131, filed on Jan. 29, 2004.
(60) Provisional application No. 60/532,121, filed on Dec. 23, 2003.

(51) Int. Cl.
*A47B 13/08* (2006.01)

(52) U.S. Cl. ..... 108/90
(58) Field of Classification Search ..... None
See application file for complete search history.

(56) References Cited

U.S. PATENT DOCUMENTS

| | | | | | |
|---|---|---|---|---|---|
| 1,926,429 | A | * | 9/1933 | Bendelari | 108/90 |
| 3,010,639 | A | * | 11/1961 | Govatsos | 229/198.2 |
| 3,156,280 | A | * | 11/1964 | Affholter | 108/90 |
| 3,703,201 | A | | 11/1972 | Musyt | |
| 3,916,783 | A | * | 11/1975 | Filsinger et al. | 101/21 |
| 4,766,301 | A | * | 8/1988 | Evers | 235/487 |
| 4,773,961 | A | | 9/1988 | Glorioso | |
| 4,801,482 | A | * | 1/1989 | Goggans et al. | 428/68 |
| 5,232,606 | A | * | 8/1993 | Leidner | 210/773 |
| 5,443,020 | A | * | 8/1995 | Price | 108/115 |
| 6,508,183 | B2 | | 1/2003 | Kerrigan | |

FOREIGN PATENT DOCUMENTS

JP 2773313 7/1998

OTHER PUBLICATIONS

Archived webpage of Americo Inc. (www.americo–inc.com).
Marko, Carlise Catalog Jun. 2001.

* cited by examiner

*Primary Examiner*—Aaron J. Lewis

(57) ABSTRACT

Fitted tablecloth coverings that may be affixed to a table without the use of a tool or affixing devices are manufactured from polymeric film with prefitted corners. Methods of manufacturing a tablecloth from polymeric film with prefitted corners provide a covering that may conveniently and quickly be applied to a table to provide an appealing visual presentation that does not require the use of installation tools and that will not damage the table.

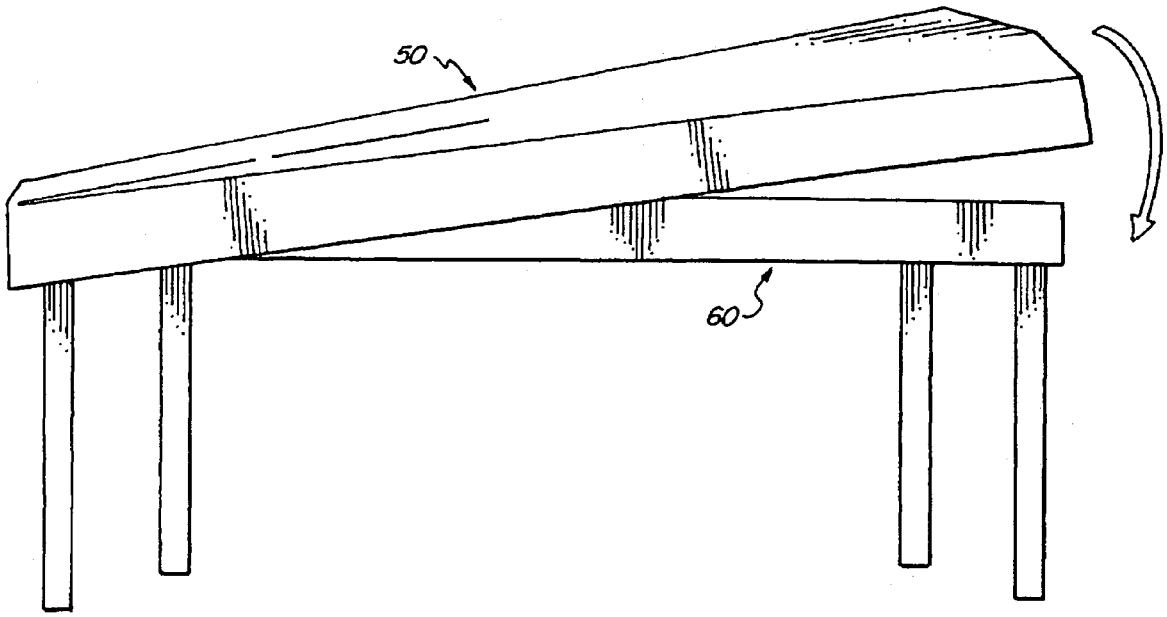

EX PARTE REEXAMINATION CERTIFICATE ISSUED UNDER 35 U.S.C. 307

THE PATENT IS HEREBY AMENDED AS INDICATED BELOW.

Matter enclosed in heavy brackets [ ] appeared in the patent, but has been deleted and is no longer a part of the patent; matter printed in italics indicates additions made to the patent.

AS A RESULT OF REEXAMINATION, IT HAS BEEN DETERMINED THAT:

Claim 7 is cancelled.

Claims 1, 6, 8 and 11 are determined to be patentable as amended.

Claims 2–5, 9, 10 and 12–23, dependent on an amended claim are determined to be patentable.

New claims 24–32 are added and determined to be patentable.

1. A table cover for covering a generally rectangular table of pre-determined size comprising:

a top surface made of a polymeric film having a generally rectangular configuration with a length and a width and four edges;

four sides formed of the polymeric film, each extending outwardly from a respective one of the edges of the top surface and bent down at an angle of about 90° from the top surface such that the four sides together define a length and a width that is substantially the same as the length and the width of the top surface, and each of the four sides having a free edge opposite to a respective edge of the top surface and two end edges orthogonal to the top surface;

wherein the adjacent end edges of each of two respective sides abut one another and are permanently joined together to define four corners to hold the table cover on the table; [and]

wherein the free edges of each of the four sides together define a length and a width that are substantially the same as the length and the width of the top surface*;*

*wherein the generally rectangular table of pre-determined size is a table having a standard length and width;*

*wherein the length of the top surface is shorter than the standard length of the table such that the polymeric film of which the top surface is made is stretched to fit the table when the table cover is installed on the table; and*

*wherein the table cover is monolithic and consists essentially of a single piece of thin vinyl.*

6. The table cover claim 1, wherein the table [cover] is [for covering] a trade show table [of a standard length and width].

8. The table cover of claim [7] *1*, wherein the table cover further comprises a size identification disposed on a location of the table cover visible to a user for selection prior to placement on the table.

11. A method of forming a table cover for covering a table of generally pre-determined size and having a top surface and a plurality of sides, said method comprising the steps of:

providing a polymeric film in a generally rectangular shape having a length and width*, four terminal outermost edges* and four corners;

removing generally rectangular portions of the polymeric film at each of the four corners of the polymeric film so as to define a generally rectangular central portion having a length and a width and four generally rectangular side portions, each side portion having an edge contiguous with the central portion, each side portion having two opposite ends created by the removal of polymeric material, and each side portion terminating at [a free edge] *one of the four terminal outermost edges* opposite to the edge that is contiguous with the central portion;

bending each of the four side portions to be generally orthogonal to the central portion such that each one of the two opposite ends of each side portion abut another one of the two opposite ends of another adjacent side portion and such that the [free] *terminal* edges of the side portions define a length and a width that are substantially the same as the length and the width of the central portion; and permanently joining the abutting ends of the side portions to form four fitted corners of the table cover that hold the table cover on the table once the table cover is placed thereon.

*24. The table cover of claim 1 wherein the length of the top surface is from about 1% to about 5% shorter than the standard length of the table.*

*25. The table cover of claim 24 wherein the standard length of the table is about 48 inches and the length of the top surface falls within a range from about 46 inches to about 47.5 inches.*

*26. The table cover of claim 24 wherein the standard length of the table is about 72 inches and the length of the top surface falls within a range from about 69 inches to about 71 inches.*

*27. The table cover of claim 24 wherein the standard length of the table is about 96 inches and the length of the top surface falls within a range from about 92 inches to about 95 inches.*

*28. The table cover of claim 1 wherein the width of the top surface is shorter than the standard width of the table.*

*29. The table cover of claim 28 wherein the width of the top surface is from about 1% to about 5% shorter than the standard width of the table.*

*30. The table cover of claim 29 wherein the standard width of the table is about 18 inches and the width of the top surface is about 17.5 inches.*

*31. The table cover of claim 29 wherein the standard width of the table is about 24 inches and the width of the top surface is about 23.5 inches.*

*32. The table cover of claim 29 wherein the standard width of the table is about 30 inches and the width of the top surface is about 29 inches.*

* * * * *

US007178470C2

(12) EX PARTE REEXAMINATION CERTIFICATE (9563rd)

United States Patent
Edinger et al.

(10) Number: US 7,178,470 C2
(45) Certificate Issued: Mar. 13, 2013

(54) TABLECLOTH COVERING AND METHOD OF COVERING AND SKIRTING A TABLE

(75) Inventors: Larry Edinger, Westwood, NJ (US); Walter Jones, River Vale, NJ (US); Julian Chan, Chai Wan (HK)

(73) Assignee: SMT Solutions, Inc., Hackensack, NJ (US)

Reexamination Request:
No. 90/012,257, Apr. 20, 2012

Reexamination Certificate for:

| | |
|---|---|
| Patent No.: | **7,178,470** |
| Issued: | **Feb. 20, 2007** |
| Appl. No.: | **11/074,091** |
| Filed: | **Mar. 7, 2005** |

Reexamination Certificate C1 7,178,470 issued Nov. 18, 2008

Related U.S. Application Data

(63) Continuation-in-part of application No. 10/767,131, filed on Jan. 29, 2004, now Pat. No. 8,196, 528.

(60) Provisional application No. 60/532,121, filed on Dec. 23, 2003.

(51) Int. Cl.
*A47B 13/08* (2006.01)

(52) U.S. Cl. ..... 108/90

(58) Field of Classification Search ..... None
See application file for complete search history.

(56) References Cited

To view the complete listing of prior art documents cited during the proceeding for Reexamination Control Number 90/012,257, please refer to the USPTO's public Patent Application Information Retrieval (PAIR) system under the Display References tab.

*Primary Examiner* — Patricia Engle

(57) ABSTRACT

Fitted tablecloth coverings that may be affixed to a table without the use of a tool or affixing devices are manufactured from polymeric film with prefitted corners. Methods of manufacturing a tablecloth from polymeric film with prefitted corners provide a covering that may conveniently and quickly be applied to a table to provide an appealing visual presentation that does not require the use of installation tools and that will not damage the table.

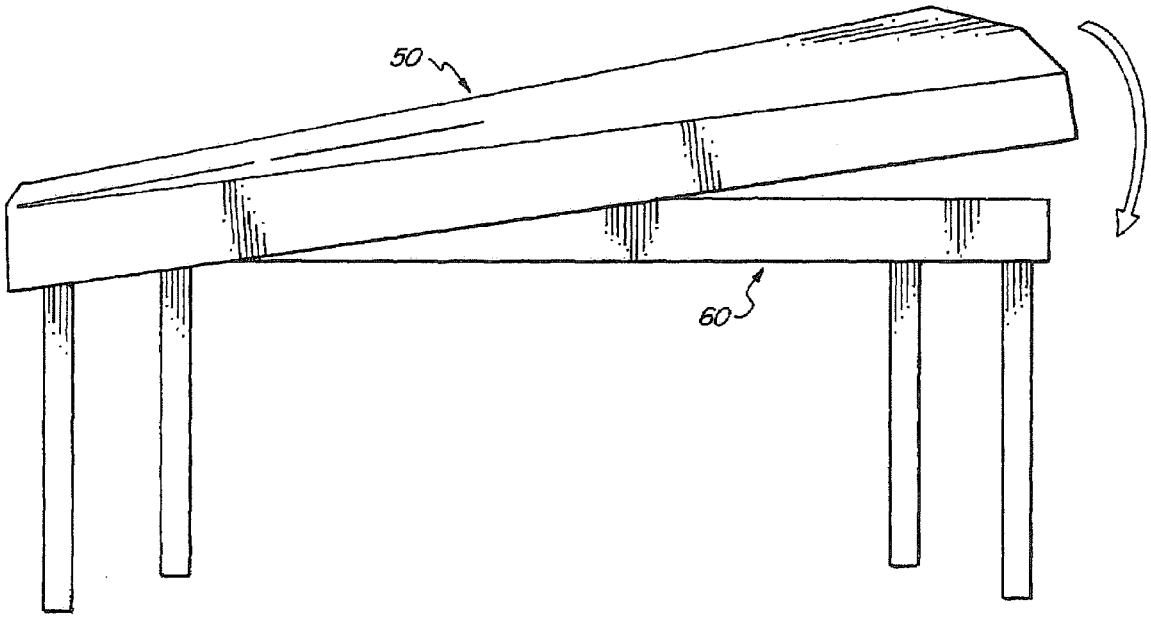

EX PARTE REEXAMINATION CERTIFICATE ISSUED UNDER 35 U.S.C. 307

THE PATENT IS HEREBY AMENDED AS INDICATED BELOW.

AS A RESULT OF REEXAMINATION, IT HAS BEEN DETERMINED THAT:

Claim 7 was previously cancelled.

Claims 1-6 and 8-32 are cancelled.

* * * * *